US008011612B2

(12) United States Patent
Gelli et al.

(10) Patent No.: US 8,011,612 B2
(45) **Date of Patent: *Sep. 6, 2011**

(54) METHOD AND MACHINE FOR THE PRODUCTION OF LOGS OF WEB MATERIAL

(75) Inventors: Mauro Gelli, Lucca (IT); Romano Maddaleni, Pisa (IT); Giovanni Nencioni, Pisa (IT)

(73) Assignee: Fabio Perini S.p.A., Lucca (IT)

( * ) Notice: Subject to any disclaimer, the term of this patent is extended or adjusted under 35 U.S.C. 154(b) by 989 days.

This patent is subject to a terminal disclaimer.

(21) Appl. No.: 10/581,725

(22) PCT Filed: Nov. 25, 2004

(86) PCT No.: PCT/IT2004/000652

§ 371 (c)(1),
(2), (4) Date: Jun. 28, 2006

(87) PCT Pub. No.: WO2005/054104

PCT Pub. Date: Jun. 16, 2005

(65) Prior Publication Data

US 2008/0290207 A1 Nov. 27, 2008

(30) Foreign Application Priority Data

Dec. 5, 2003 (IT) ..... FI2003A0312
Apr. 13, 2004 (IT) ..... FI2004A0086

(51) Int. Cl.
*B65H 19/28* (2006.01)

(52) U.S. Cl. ..... 242/532.2; 242/533; 242/541.3

(58) Field of Classification Search ..... 242/526.1, 242/532.2, 533, 533.1, 533.3, 535.4, 541.3, 242/542.1

See application file for complete search history.

(56) References Cited

U.S. PATENT DOCUMENTS

| | | | |
|---|---|---|---|
| 3,123,315 | A | 3/1964 | Couzens |
| 4,327,877 | A | 5/1982 | Perini |
| 4,487,377 | A | 12/1984 | Perini |
| 4,909,492 | A | 3/1990 | Biagiotti |
| 4,962,897 | A | 10/1990 | Bradley |
| 5,031,850 | A | 7/1991 | Biagiotti |
| 5,040,738 | A | 8/1991 | Biagiotti |
| 5,137,225 | A | 8/1992 | Biagiotti |
| 5,248,106 | A | 9/1993 | Biagiotti |
| 5,249,756 | A | 10/1993 | Biagiotti |
| 5,267,703 | A | 12/1993 | Biagiotti |
| 5,368,252 | A | 11/1994 | Biagiotti |
| 5,538,199 | A | 7/1996 | Biagiotti |
| 5,542,622 | A | 8/1996 | Biagiotti |
| 5,639,046 | A | 6/1997 | Biagiotti |
| 5,690,296 | A | 11/1997 | Biagiotti |
| 5,769,352 | A | 6/1998 | Biagiotti |
| 5,839,680 | A | 11/1998 | Biagiotti |
| 5,979,818 | A | 11/1999 | Perini et al. |
| 6,056,229 | A | 5/2000 | Blume et al. |

(Continued)

FOREIGN PATENT DOCUMENTS

EP 0 199 286 A2 10/1986

(Continued)

*Primary Examiner* — Sang Kim

(74) *Attorney, Agent, or Firm* — Breiner & Breiner, L.L.C.

(57) ABSTRACT

The rewinding machine includes a winding system and a feed path for a web material towards the winding system. Along the feed path is a channel for insertion of the cores and an interruption member which acts on the web material.

62 Claims, 13 Drawing Sheets

U.S. PATENT DOCUMENTS

| | | | | |
|---|---|---|---|---|
| 6,648,266 | B1 | 11/2003 | Biagiotti et al. | |
| 6,695,245 | B1 * | 2/2004 | Schultz et al. | 242/532.2 |
| 6,698,681 | B1 * | 3/2004 | Guy et al. | 242/534 |
| 6,752,344 | B1 | 6/2004 | Biagiotti | |
| 2003/0080234 | A1 | 5/2003 | Baggot et al. | |
| 2003/0189123 | A1 | 10/2003 | Biagiotti et al. | |
| 2006/0169733 | A1 | 8/2006 | Perini | |
| 2008/0283656 | A1 * | 11/2008 | Gelli | 242/521 |
| 2009/0039195 | A1 | 2/2009 | Perini | |

FOREIGN PATENT DOCUMENTS

| | | | |
|---|---|---|---|
| EP | 1 219 555 | A1 | 7/2002 |
| GB | 1 435 525 | | 5/1976 |
| GB | 2 009 108 | A | 6/1979 |
| GB | 2 105 687 | A | 3/1983 |
| GB | 2 150 536 | A | 7/1985 |
| IT | MI1995A001174 | | 8/1997 |
| JP | 06-135604 | | 5/1994 |
| WO | WO 01/72620 | A1 | 10/2001 |
| WO | WO 2004/035441 | A1 | 4/2004 |
| WO | WO 2004/046006 | A2 | 6/2004 |
| WO | WO 2004/050520 | A2 | 6/2004 |
| WO | WO 2004/071914 | A1 | 8/2004 |

* cited by examiner

METHOD AND MACHINE FOR THE PRODUCTION OF LOGS OF WEB MATERIAL

TECHNICAL FIELD

The present invention concerns a rewinding machine for winding a web material to form logs intended for example but not exclusively for the production of toilet rolls, kitchen paper and similar. More in particular, but not exclusively, the invention concerns a so-called surface rewinding machine, i.e. in which the logs are formed by winding the web material in a winding cradle formed by winding members in contact with the outer surface of the log. The invention also concerns a winding method and more in particular, but not exclusively, a so-called surface winding method.

STATE OF THE ART

For the production of rolls or logs of paper, so-called tissue paper or other web materials rewinding machines are used to which the material to be wound is fed, and which produce logs with a pre-set quantity of wound material. The web material is fed typically by unwinders, i.e. machines that unwind one or more large diameter reels coming, for example, from a paper mill.

The logs can be sold as is, or can undergo further transformation operations; typically they are cut into logs of shorter axial length, equal to the final dimension of the rolls offered for sale.

The rewinding is in some cases performed by so-called central rewinding machines, i.e. in which the logs are formed around motor-driven mandrels, on which winding cores made of cardboard or similar material may be fitted, designed to remain inside the logs.

The latest rewinding machines are based on the principle of so-called peripheral or surface winding. In this case the log forms in a winding cradle, defined by rotating winding rollers or by other winding members such as belts, or combinations of rollers and belts.

Combined systems are also known in which the winding is obtained by means of surface members, combined with a system for control of the log axis in the formation phase. In both the central winding systems and surface winding systems machines are sometimes used in which the mandrel or winding core is extracted from the finished log so that the end product is a log provided with a central hole, without axial core. Examples of peripheral rewinding machines of this type are described in WO-A-0172620.

The rewinding machines, both surface and central, operate automatically and continuously, i.e. the web material is fed in continuously without stopping and at a substantially constant speed. The web material is provided with crosswise perforation lines which divide the material into single portions which can be separated from the log for the end use. Typically the aim is to produce logs with a pre-set and precise number of said portions or sheets.

When a roll or log has been completed, the switchover phase must be performed in which the log formed is discharged and the web material is interrupted, forming a final edge of the complete log and an initial edge of the subsequent log. The initial edge begins to wind to form a new log. The interruption occurs preferably along a perforation line, so that the end product contains a whole pre-set number of portions of web material.

These operations take place without substantial variations in the feed speed of the web material and represent the most critical moment of the winding cycle. In modern rewinding machines for the production of tissue paper, the feed speed of the web material reaches and exceeds speeds in the order of 1000 m/min, with winding cycles at times lasting less than 2 seconds.

It is therefore important to provide efficient, reliable and flexible systems for interruption of the web material at the end of winding of each roll or log.

In GB-A-1435525 a rewinding machine is described in which interruption of the web material is performed by means of a blade or jet of compressed air which tears the web material or generates a loop which wedges between the new winding core inserted in the winding cradle and one of the winding rollers.

In U.S. Pat. No. 4,327,877 a rewinding machine is described in which the web material is interrupted by the combined action of suction across the surface of one of the winding rollers and pinching of the web material between the new core inserted in the winding cradle and the suction winding roller. The suction forms a loop of material which is pinched and pulled in the opposite direction with respect to that of feed of the web material which winds around the log as it is being completed.

In GB-A-2150536 and U.S. Pat. No. 5,368,252 rewinding methods and machines are described in which the web material is torn at the end of winding solely by means of controlled acceleration of one of the winding rollers. The same system based on the principle of tearing the web material along a perforation line by means of acceleration of one of the winding rollers is described in EP-A-1.219.555.

In GB-A-2105687 a rewinding method and a machine are described in which interruption of the web material is performed via cutting by a blade in a channel of one of the winding rollers.

In U.S. Pat. No. 5,137,225 and EP-A-0199286 rewinding methods and machines are described in which the tear is performed by cooperation of a winding core with a fixed surface against which the core pinches the web material causing it to stop or temporarily slow down.

In IT-B-1.275.313 a device is described in which the web material is torn by a core taker-in which cooperates with the main winding roller.

In U.S. Pat. No. 6,056,229 a rewinding machine is described in which the web material is interrupted by pinching it between a fixed surface and a movable member which also constitutes the machine winding core taker-in.

A particularly reliable and flexible method and machine are described in U.S. Pat. No. 5,979,818. In this case the tear is performed by a movable member which cooperates with one of the winding rollers around which the web material is guided, or with a belt running around said roller and which sustains the web material as it is fed towards the winding cradle. The difference in speed between the winding roller and the web material on the one hand and the movable member on the other causes tearing of the web material along a perforated line. With respect to the preceding tear systems, this known rewinding machine permits very high winding precision, also at high speed, with a relatively simple and economic configuration, which also permits high production flexibility.

From the evolution represented by the machines and methods described in the above-mentioned patents, it is evidently necessary to produce tear and winding start systems that are increasingly efficient and reliable also at high speeds and which permit a high level of flexibility, i.e. the possibility of varying the winding parameters in a simple manner, in particular the length of web material wound on each log or the distance between successive perforation lines on the web material.

OBJECTS AND SUMMARY OF THE INVENTION

The aim of the invention is to produce a winding method and a rewinding machine that are particularly efficient, economic and reliable and which guarantee a high level of production flexibility.

These and further objects and advantages, which will appear clear to persons skilled in the art from reading of the following text, are substantially achieved with a rewinding machine comprising: a path for feeding the web material towards a winding system; an interruption member to interrupt the web material at the end of winding of the log; a core feeder to insert winding cores in succession in a channel defined by a rolling surface and a movable core feed member, arranged so that when a core is inserted in said channel the web material is located between said core and said feed member and in contact with said feed member; characterized in that the interruption member is combined with said feed member and positioned on the opposite side with respect to the channel to act on the web material via said feed member. With this arrangement the entire area below the core rolling surface is free and this results in a series of advantages, including possible simplification of the structure defining the core rolling surface, or the possibility of using nozzles positioned above and below the core channel to wrap the first turn of web material around the new core without the need to apply glue on the latter.

In an advantageous embodiment the feed member comprises a flexible member, for example advantageously consisting of a plurality of parallel belts, running between at least two rollers. The interruption member is in said case advantageously positioned between said two rollers, within the closed path defined by the flexible member. One of said rollers can constitute the first winding roller of a surface winding cradle forming the winding system, which in this case is a surface winding system.

In a possible embodiment of the invention, the interruption member is a suction member which applies a force on said web material, obstructing the feed thereof. For example the suction member can comprise a counter surface along which said flexible member runs.

In an alternative embodiment, the interruption member is a mechanical member which acts on the web material obstructing the feed thereof. For example, the mechanical interruption member can be synchronized with the core feeder to act on the web material in conjunction with a winding core which is moving along the channel. The web material can, in this case, be pinched between the core and the interruption member. It is also possible for the interruption member to act at a different point, preferably downstream of the core in the feed direction of the web material.

According to a different aspect the invention concerns a method for the production of logs of wound web material, comprising the following steps:

- feeding the web material to a winding system;
- winding a first log of web material around a first winding core;
- inserting a new winding core in a channel defined between a rolling surface and a movable core feed member and feeding of said core along said channel, with the web material between said core and said feed member;
- interrupting the web material at the end of winding of said first log, forming a final free edge of said first log and a initial free edge for winding of a second log;

characterized in that said web material is interrupted by means of an interruption member which acts on the web material along the channel on the side of the feed member and across it.

According to a further aspect of the invention, the interruption member comprises at least one diverter element, such as for example an elastic lamina, which acts on the web material across, that is through the feed member, protruding into the above-mentioned channel when the web material has to be interrupted.

According to a further aspect, the invention concerns a method for the production of logs of wound web material, comprising the following phases:

- feeding the web material to a winding system along a feed path;
- winding a first log of web material around a first winding core;
- interrupting the web material at the end of winding of said first log elongating the path of the web material between the first log and a pinching point of the web material, to form a free final edge of the first log and a free initial edge for winding a second log.

In practice, according to an advantageous embodiment of the method of the present invention, the pinching point is defined by the new core and by a movable feed member. However, the pinching point can be defined differently, for example by means of a movable member which presses the web material against a winding roller, an idler roller, a flexible feed member or other. The movable member, since it does not operate as interruption member of the web material, can—at the moment of contact with the web material—move at the same speed as the material itself.

In a possible embodiment, the path of the web material is elongated inserting a diverter element between the feed member and the web material downstream of the contact position between said second core and the web material, with respect to the feed direction of the web material.

A further aspect of the present invention concerns a rewinding machine comprising: a feed path of the web material towards a winding system and a core feeder to insert winding cores in succession towards the winding system. According to the invention, along the feed path a diverter element is provided, positioned and controlled to elongate the path of the web material between a completed log and a pinching point of the web material.

Further advantageous features and embodiments of the rewinding machine and the winding method according to the invention are indicated in the appended claims and will be described in greater detail below with reference to some advantageous embodiment examples.

BRIEF DESCRIPTION OF THE DRAWINGS

The invention will be better understood by following the description of practical and advantageous non-limiting embodiment examples of the invention, shown in the appended drawings. In the drawings.

DETAILED DESCRIPTION OF THE PREFERRED EMBODIMENTS OF THE INVENTION

Figure 1A:
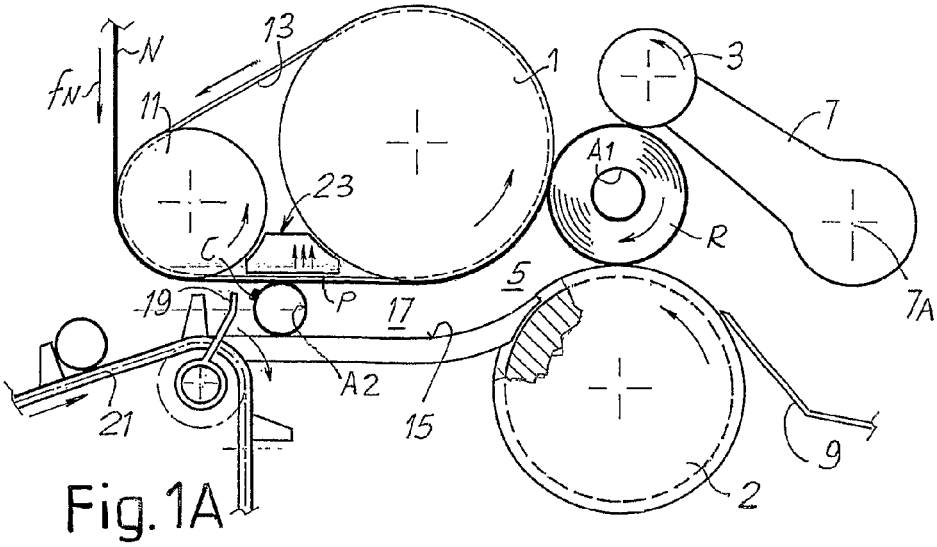
FIG. 1A to 1C show an operating sequence of a machine according to the invention in a first embodiment.

Embodiment examples with a surface winding system are described below. It should however be understood that the principles underlying the invention can also be combined with a central winding system.

The appended drawing shows the basic elements of the machine according to the invention, in a representation that illustrates the operating mode thereof. In the embodiment illustrated in FIG. 1A, 1B, 1C, the rewinding machine comprises a winding cradle formed by three winding rollers, namely: a first winding roller 1, a second winding roller 2 and a third winding roller 3. The three rollers 1, 2, 3 rotate around parallel axes and at peripheral speeds which—during the winding cycle—are substantially the same, whereas they can vary in a per se known manner at the end of winding to discharge the complete log and/or to insert the new core, around which winding of the subsequent log has begun, via a nip 5 defined between the winding rollers 1 and 2.

The winding roller 3 is supported on a pair of oscillating arms 7, hinged around an oscillation axis 7A. The oscillation movement permits build-up of the log R being formed inside the winding cradle 1, 2, 3 and discharge of the complete log via a chute 9.

The web material to be wound to form the logs R is indicated by N. It moves along a feed path which crosses a perforation unit (not shown) which perforates the material N in a known manner along perforation lines substantially orthogonal to the feed direction fN of the material N. Downstream of the perforation unit the web material N runs around a guide roller 11 revolving around an axis parallel to the axis of the winding rollers 1, 2 and 3. The web material feed path then proceeds for a section tangent to the rollers 1 and 11 defined by a flexible feed member 13 consisting of a plurality of flat parallel belts running around rollers 1 and 11. The feed member serves above all to insert and feed forward the tubular winding cores A around which the logs R are wound, as will be clarified subsequently. Since the belts forming the feed member 13 run around the rollers 1 and 11, they move forward at the same speed as the web material N and therefore there is no relative movement between the latter and the belts.

Below the portion of the feed member parallel to the web material N, there is a curved rolling surface 15 defined by a bent metal sheet or bar, a plurality of bent metal sheets or bars parallel to each other or a comb-type structure. Between the rolling surface 15 and the feed member 13 an insertion and feed channel for the winding cores is defined, indicated by 17, which is provided with an inlet on the left side of the figures and an outlet corresponding substantially to the nip 5 between the winding rollers 1 and 2. The terminal part of the channel is therefore defined between the rolling surface 15 and the outer surface of the winding roller 1 around which the feed member 13 runs, the rolling surface being arched so that it is roughly coaxial with the surface of the roller 1. The terminal part of the surface 15 penetrates into ring-shaped grooves provided in the winding roller 2, to permit easy passage of the cores that roll on the surface 15 towards the nip 5 and from here to the winding cradle 1, 2, 3.

Near the inlet of the channel 17 a core taker-in is provided, consisting of a rotating element 19 which, at the appropriate moment, inserts a winding core A in the channel 17. The cores are positioned in front of the taker-in 19 by means of a chain conveyor 21. Operation of the core insertion mechanism is known to persons skilled in the art, for example from one or more of the patents referred to in the introductory part of this description, and will not be described in further detail.

The height of the channel 17 is equal to or slightly less than the outer diameter of the winding cores A which, therefore, when they are pushed into said channel by the taker-in 19, are angularly accelerated and roll on the surface 15 pushed by the movement of the feed member 13. The web material N remains pinched between the belts forming the feed member 13 and the core inserted in the channel.

Above the lower branch of the taker-in member 13 a suction member is provided indicated overall by 23 and described in greater detail below. It has a suction area which extends crosswise to the feed direction of the cores A and to the web material N. The suction member applies suction to the web material N in the switchover phase, i.e. when the log R is almost complete and the web material N must be interrupted to generate a final free edge to be wound on the finished log R and a initial free edge to be wound on a new core A inserted in the channel 17 to start winding of a new log. The suction generates a force orthogonal to the lower surface of the suction member 23. The consequent friction force exerted on the web material by said surface is sufficient to cause tensioning and breakage of the material.

Operation of the machine described so far is as follows. FIG. 1A shows the moment immediately before breakage or interruption of the web material. The log R wound around the winding core indicated by A1 is ready to be expelled from the winding cradle, while a new core A2 has just been inserted by the taker-in 19 into the channel 17. Advantageously, the configuration of the channel 17 is such that the core A2 comes into contact with the belts forming the member 13 and with the roller 11 before coming into contact with the fixed counter surface formed by the lower part of the suction member 23. In this way it is rapidly angularly accelerated until its contact point with the web material is brought to the same feed speed as the web material.

The rolling surface 15 has a comb-type structure or at least a series of notches which allow the taker-in 19 to complete the rotation around its own rotation axis and prepare for insertion of the next core.

P indicates the position of a crosswise perforation line, generated on the web material N by the perforator (not shown), along which the web material will be torn. The perforation P is located immediately downstream of a suction area defined by suction apertures, slots or holes along a lower surface of a suction box formed by the suction member 23.

The suction is controlled and timed in order to operate when the perforation line P is in the position indicated in FIG. 1A, or slightly farther downstream in the feed direction of the web material N. In this way, when the suction is activated, the web material is braked sharply, in the area where the suction holes or apertures are located. As the log R continues to rotate, the web material between the tangent point with the log R and the suction area is tensioned and tears along the perforation line P, which constitutes the weakest section of the web material. The winding roller 1 has a surface with a high friction coefficient between the belts 13A that form the member 13, so that tearing of the web material occurs on the perforation line nearest the area in which the suction is applied. In practice, the high friction coefficient of the surface of the roller 1 with which the web material N is in contact prevents spreading of the tension downstream, towards the log R1 which is being completed.

The core A2 is already in contact with the web material N upstream of the tearing and suction area and has already been set to rotation. It holds the web material N against the belts forming the feed member 13 and thus prevents loss of the initial free edge Li of web material N that has formed due to the tear. Furthermore the core circumscribes and limits the stretch of web material that slackens due to the braking imposed by the suction. In fact, the web material upstream of the contact area with the core A2 does not slacken, with consequent advantages in terms of absence of wrinkles in the inner turns of the log. The final free edge Lf of the log R finishes winding on the log, which is expelled by varying the peripheral speed of the roller 2 and/or of the roller 3, in a per se known manner. To facilitate tearing or interruption of the web material by means of the suction applied on it, it is also possible to temporarily accelerate the winding roller 3 before activating the suction. This acceleration, even a slight one, pre-tensions the web material and guarantees tearing as soon as the suction is activated.

In the example illustrated, on the surface of the core A2 a strip of glue has been applied parallel to the axis of the core. Said strip of glue is located, in the set-up shown in FIG. 1A, slightly upstream of the pinching point of the web material N and therefore after a brief rolling movement of the core, the material sticks to the core.

Since the rollers 1 and 11 continue to rotate, after breakage of the web material the feed member 13 continues to roll and to feed the core A2 along the channel 17. The point of contact between core and feed member 13 exceeds the suction area (FIG. 1B) and the initial free edge Li of the web material N adheres to the core due to the strip of glue applied on it, thus starting winding of a new log. The finished log R is still in the winding cradle, but could also have initiated its discharge movement. In this phase the suction has already been interrupted.

Figure 1B:
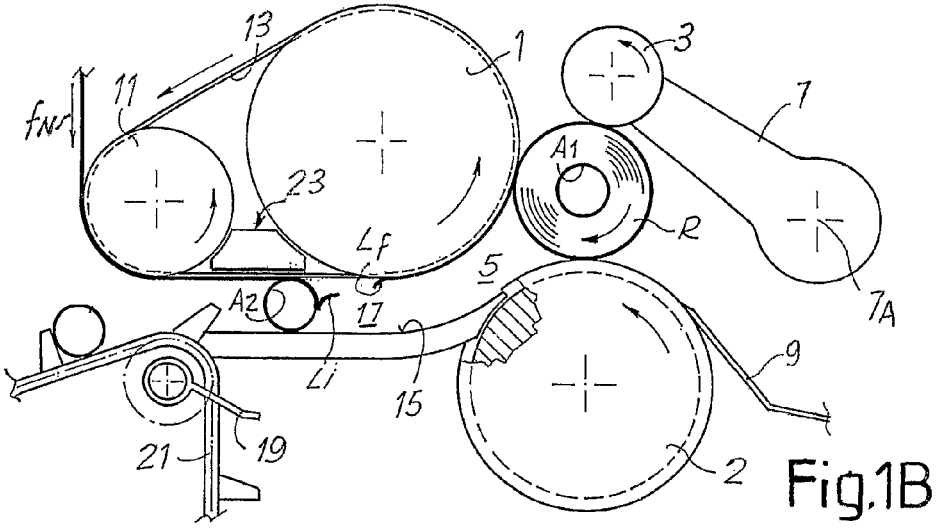
Figure 1C:
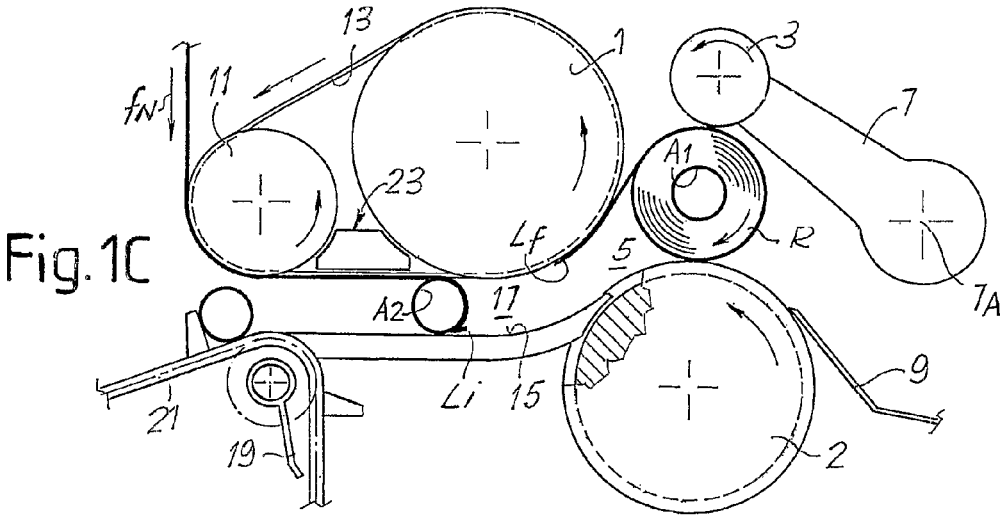

In FIG. 1C the winding core A2 has performed a further rotation of approximately 90° with respect to the position of FIG. 1B and the area of the initial free edge Li glued to the core begins to turn around the core, locating in the pressure area between the core and the rolling surface 15. The core A2 continues to roll until it reaches the winding cradle 1, 2, 3 passing through the nip 5. In the winding cradle formation of the next log around the core A2 is completed, the log R having been discharged by the winding cradle.

Once winding of the new log around the core A2 has been completed, the switchover cycle described above is repeated.

Instead of using glue to obtain adhesion of the initial free edge Li around the core and formation of the first turn around the core, one or more sets of blower nozzles can be used, appropriately arranged around the area in which the core receives the free edge. This solution is facilitated by the fact that below the rolling surface 15 no mechanical members are provided for tearing the web material, as in other known machines. For example nozzles can be provided arranged above and below the channel 17, appropriately directed to force the free edge to wind around the core forming the first turn, as will be described subsequently with reference to a further embodiment example.

Figure 2A:
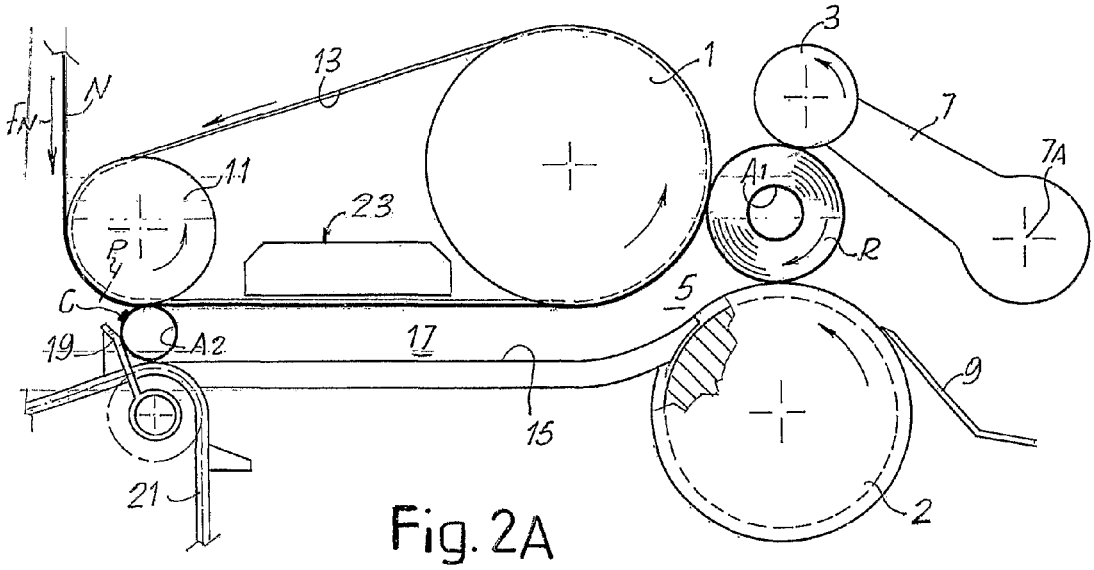
FIG. 2A to 2D show an operating sequence of a machine according to the invention in a second embodiment.
Figure 2B:
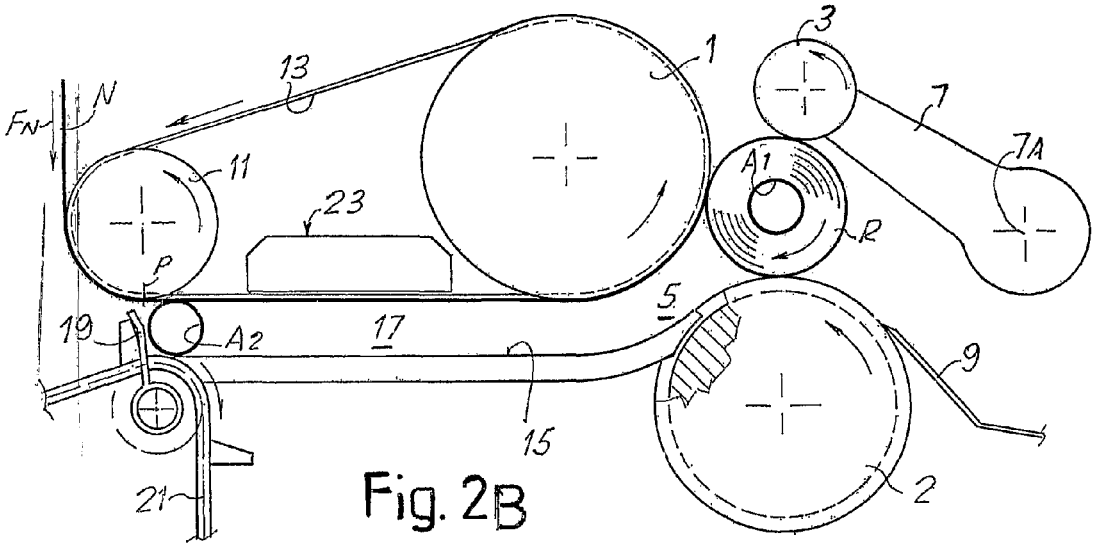

FIG. 2A-2D show a second embodiment of the machine according to the invention, with respective operating sequence. Equal numbers indicate parts equal or corresponding to those of the preceding FIG. 1A-1C. The main difference with respect to the preceding embodiment example is the greater distance between the rollers 1 and 11 and the greater extent of the counter surface defined by the suction member 23 and the belts 13A. Otherwise, the arrangement and the operating sequence is substantially the same. In the example illustrated in FIG. 2A-2D, however, the core performs a complete rotation in the channel 17 before interruption of the web material, as can be observed from the comparison between FIGS. 2A and 2C. The strip of glue is indicated by C. When the core is about to be inserted in the channel 17 (FIG. 2A) it is positioned so that it comes into contact with the web material after a moderate rotation of the core and therefore after it has been fed forward for a limited distance into the channel 17. FIG. 2B shows the moment when the strip of glue C comes into contact with the web material. P again indicates the position of the perforation line along which the web material will be torn. In FIGS. 2A and 2B said perforation line is upstream of the core A2.

When it is in the position of FIG. 2B, the winding core A2 transfers part of the glue C to a portion of the web material N downstream of the perforation line P along which the web material will be subsequently interrupted and in the vicinity of said line. Therefore, part of the glue (indicated in the subsequent figures by C1) is transferred to the final free edge of the log R.

Figure 2C:
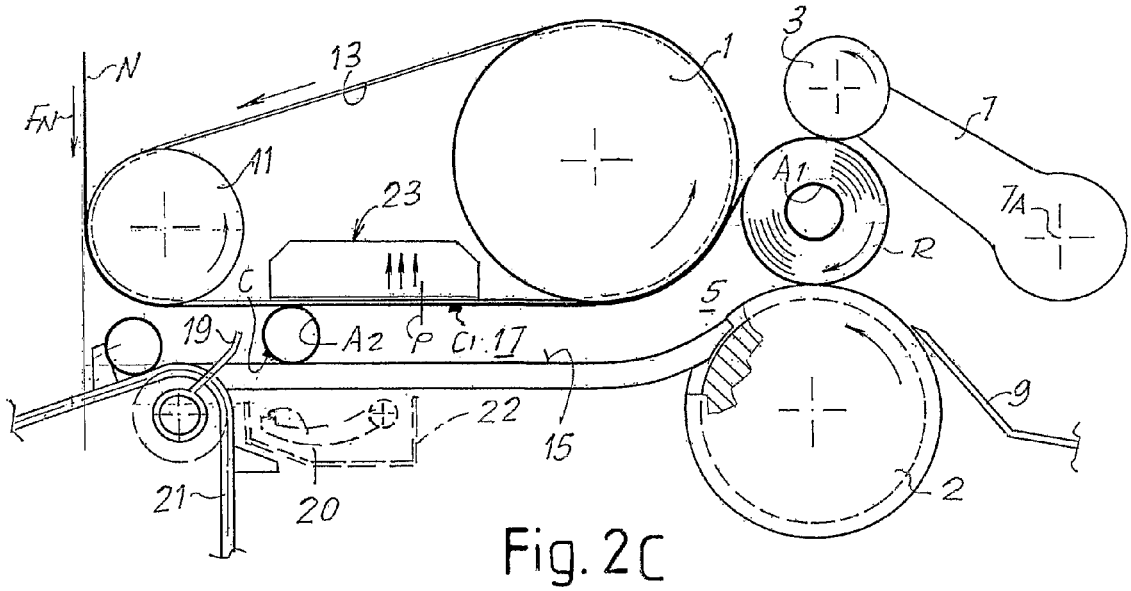

In FIG. 2C the suction begins, braking the web material N which breaks along the perforation line P, which at this point has passed beyond the position of the winding core A2 and is downstream of it with respect to the feed direction of the web material. This is due to the fact that the axis of the core A2 moves along the channel 17 at half the feed speed of the web material so that the point of contact between core A2 and web material N also moves forward along the channel at a speed equal to half of the feed speed of the perforation line P. In the set-up shown in FIG. 2C the strip of glue C is in the lower part of the core. To prevent the glue dirtying the rolling surface 15 during this movement, simply ensure that the surface bars are spaced from each other, and that the strip of glue C is interrupted at the bars.

The broken line in FIG. 2C indicates an auxiliary glue dispenser consisting of an oscillating element 20 which can be immersed in a glue container 22. The oscillating element is shaped so that it can be inserted between the laminas forming the surface 15 until it touches the core A2 in order to apply on it in the required position a strip of glue C, which can overlap or be positioned beside the one previously applied and partially transferred in C1 to the final free edge of the log being completed. In this way two results are obtained: the quantity of glue is restored and a glue is applied which can have different qualities from those of the glue previously applied and partly at least transferred to the final free edge, in view of the fact that the final free edge of the log must be glued lightly so that it can be easily opened by the end user, while the initial free edge of the new log must adhere securely and immediately to the new core, with a glue that is as sticky as possible in order to guarantee a better grip.

Figure 2D:
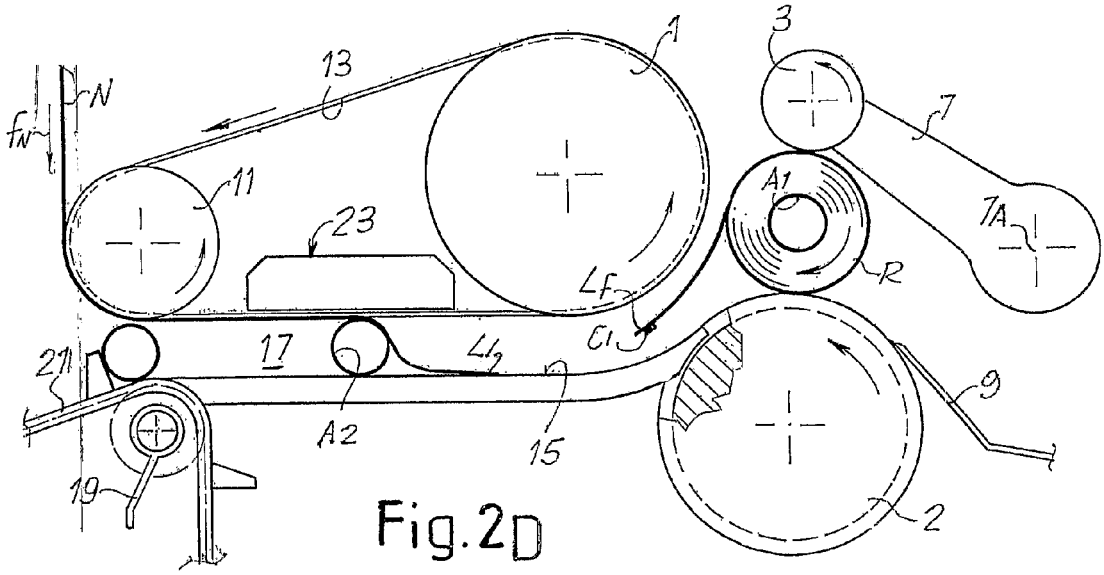

In FIG. 2D the final free edge Lf formed by the tear and provided with a strip of glue C1 transferred from the core A2 finishes winding on the log R which is being discharged from the winding cradle, while the core A2 is further fed along the channel 17, until it brings the strip of glue C into contact for the second time with the web material. This time, since the web material N is interrupted and the suction no longer operates above the new core, the initial free edge Li adheres to the core and winding of the new log begins. The core A2 will continue to roll and move forward along the channel 17 until it reaches the nip 5 and goes beyond it, entering the winding cradle 1, 2, 3.

Figure 3:
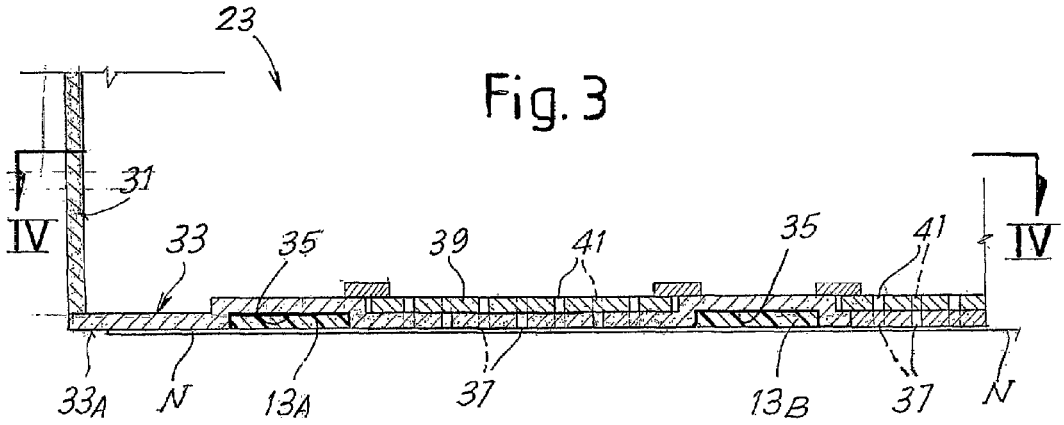
FIG. 3 shows a partially enlarged section view, according to a plane crosswise to the feed direction of the web material, the suction member and the winding core feed member.
Figure 4:
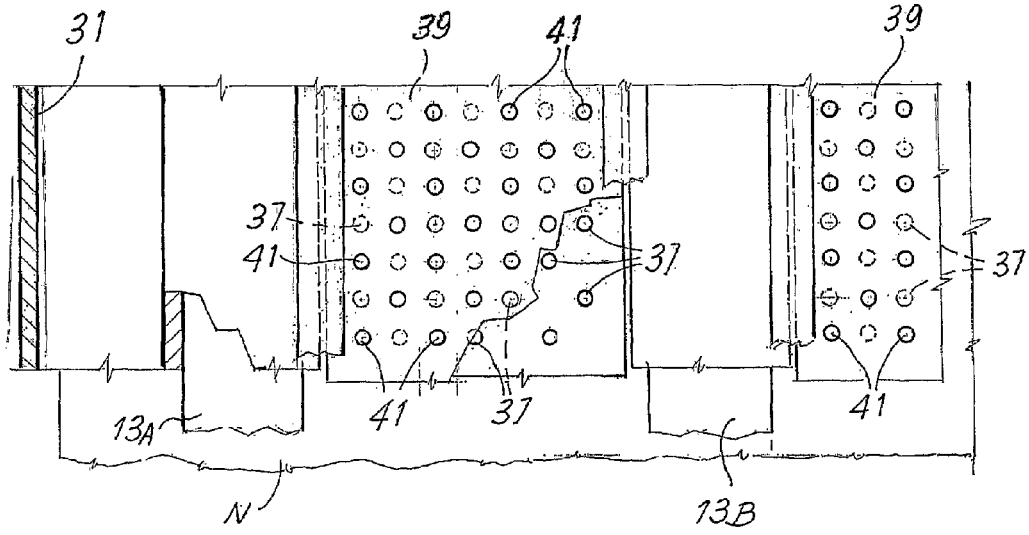
FIG. 4 shows a partial section according to IV-IV of FIG. 3.

FIGS. 3 and 4 show a cross section and a section according to IV-IV of FIG. 3, respectively, of the suction member 23. It has a suction box 31 the bottom of which is defined by a wall 33 along the outer surface 33A of which the web material runs. The outer surface of the wall 33 forms a counter surface on which the web material runs and against which it is pressed by the winding core which is inserted in the channel 17 at each switchover cycle. The wall 33 forms housings 35 parallel to the feed direction of the web material N, within which the parallel belts 13A forming the feed member 13 run. The outer surfaces of the belts 13A are flush with the outer surface 33A of the wall 33 or slightly protruding from it.

Between adjacent belts 13A the wall 33 is provided with respective perforated portions, i.e. provided with through holes, openings or apertures 37. At the level of these perforated portions inside the suction box 31 diaphragms or laminas 39 are provided sliding parallel to the feed direction of the web material N, also provided with holes 41 staggered with respect to the holes 37, as can be seen in particular in FIG. 4. The diaphragms or laminas 39 form closing and opening elements which, sliding alternatively in one direction and the other, open and close the holes 37 alternatively communicating with the inside of the suction box 31 or intercepting said communication. In this way, with the diaphragms 39 moving alternatively in one direction and the other, the suction is activated and deactivated in a timed manner according to the position of the perforation line P for tearing of the web material. The inside of the suction box 31 can remain constantly at an underpressure, i.e. at a pressure below the atmospheric pressure, thus guaranteeing rapid cut-in of the suction even when the winding cycle is very short. The underpressure in the suction box 31 is maintained for example by means of connection to a vacuum pump, a fan or other suitable suction means not shown.

Figure 5:
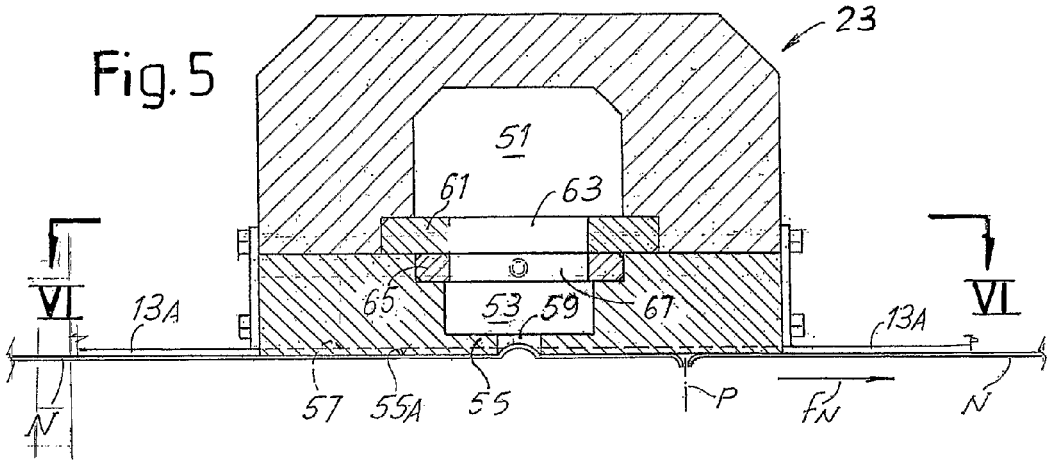
FIG. 5 shows a section of the suction member in a different embodiment.
Figure 6:
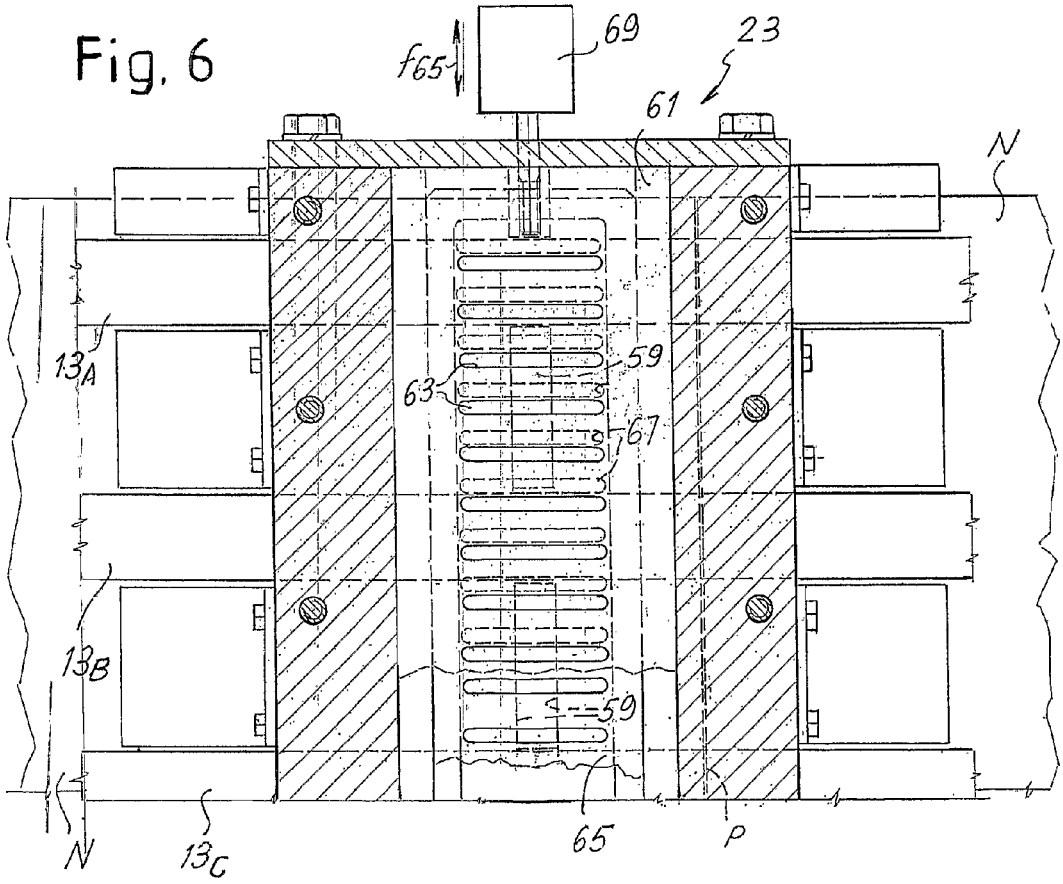
FIG. 6 shows a section according to VI-VI of FIG. 5.

FIGS. 5 and 6 show a different configuration of the suction member. In this case the suction member 23 comprises a continuous suction chamber 51, i.e. a chamber in which a pressure below the atmospheric pressure is constantly maintained. This chamber can be connected, at certain set times, to a timed suction chamber 53, the lower wall of which 55 defines a counter surface 55A having functions analogous to those of the counter wall 33A described above. In the wall 55 seats 57 are provided in which the belts 13A forming the feed member 13 run.

The wall 55 has a crosswise slot or aperture 59, if necessary interrupted at the level of the belts 13A. Via this crosswise aperture or slot 59 the braking suction effect is applied on the web material N causing breakage thereof along the perforation line P. To obtain a suction effect correctly controlled over time, of appropriate duration and timed with the passage of the perforation line P, the chambers 53 and 55 are connected via a valve system comprising a fixed plate 61 to a series of apertures or slots 63 elongated according to the feed direction of the web material N and positioned side by side crosswise to the feed direction. Below the fixed plate 61 is a sliding plate 65 provided with slots or apertures 67 extending analogously to the apertures or slots 63. The sliding plate 65 is furthermore connected to an actuator 69 which controls timed sliding of the plate according to the double arrow f65 (FIG. 6).

As can be observed in FIG. 6, the two plates 61 and 65 can be positioned so that the slots 63 and 67 are staggered and therefore the two suction chambers 51 and 53 are isolated from one another. In this case no suction is applied on the web material N. This is the set-up during normal winding of the log R. When the web material has to be torn or interrupted, the movable plate 65 is translated in one direction or the other according to the arrow f65 to align the apertures or slots 67 with the slots 63 (as in FIG. 6), and therefore connect the suction chamber 53 to the suction chamber 51. In this set-up the suction effect is exerted on the web material N, braking it and thus causing it to tear.

Figure 7:
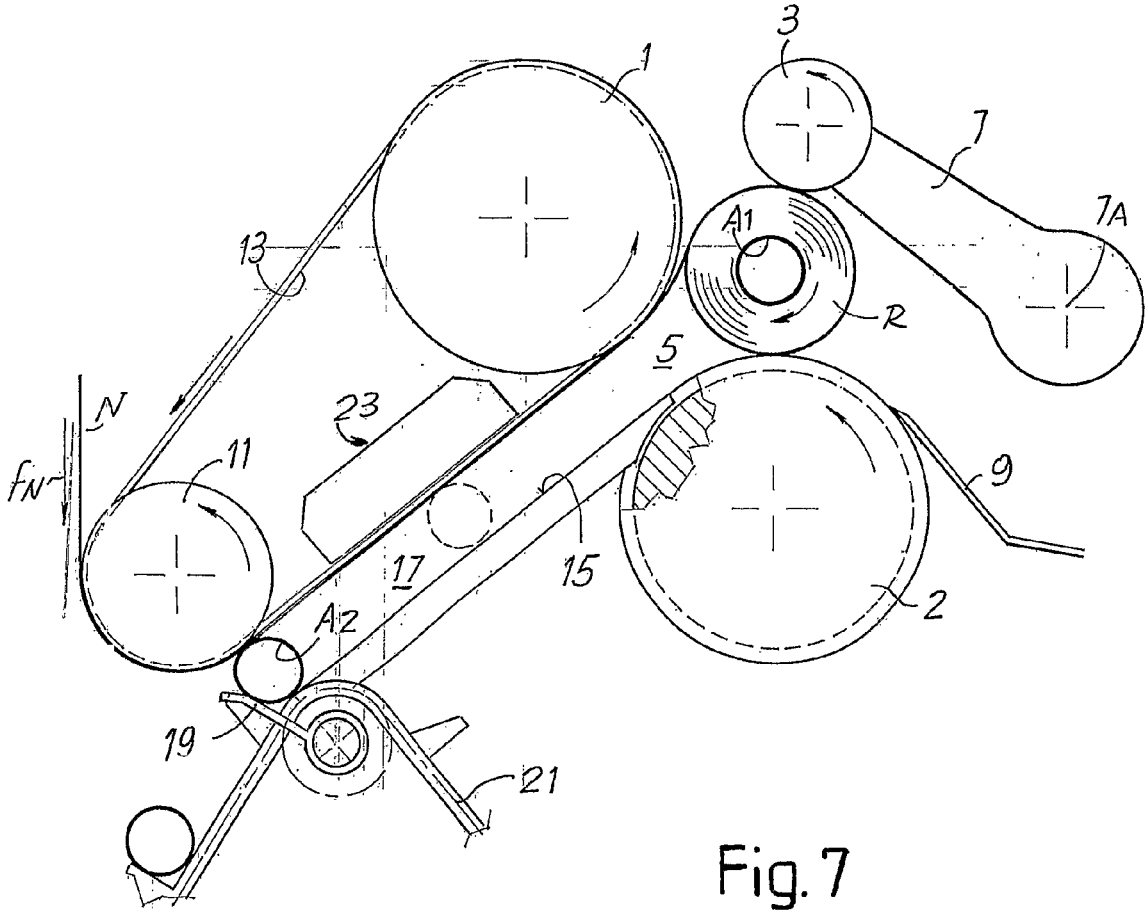
FIG. 7 shows a side view of a machine according to the invention in a further embodiment.
Figure 8:
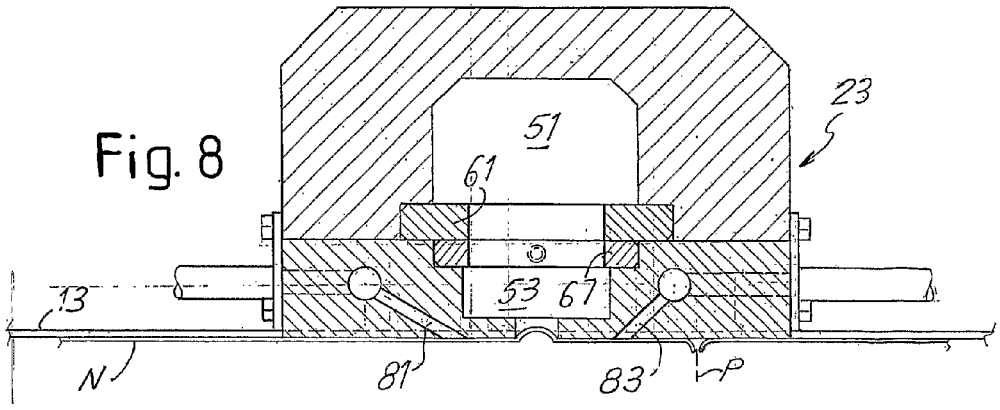
FIG. 8 shows a section of the suction member, analogous to the section of FIG. 5, in a different embodiment.
Figure 9A:
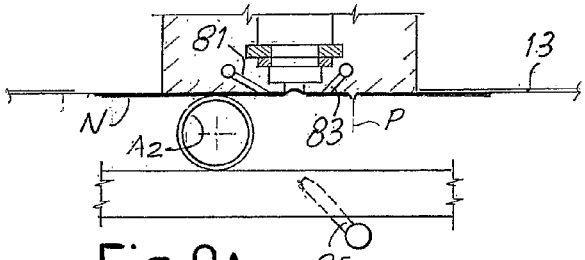
FIG. 9A-9E show schematically the sequence of the tear or interruption phase of the web material and beginning of formation of the first turn of the new log around the new core, assisted by jets of air and without glue.
Figure 9B:
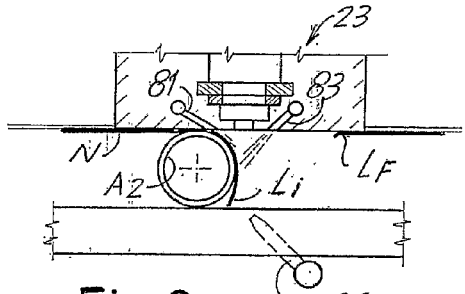
Figure 9C:
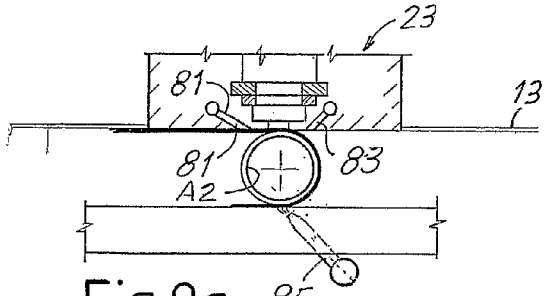
Figure 9D:
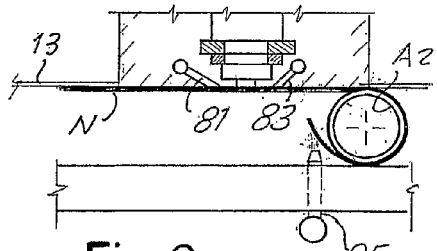
Figure 9E:
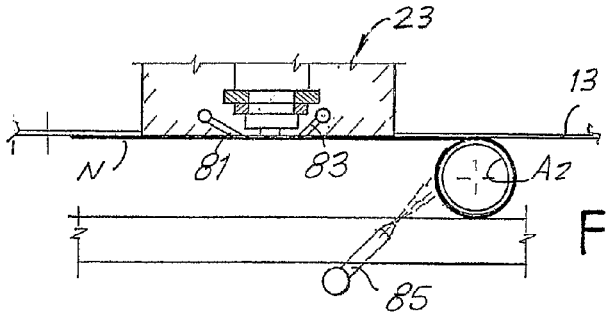

FIG. 7 shows an embodiment analogous to the embodiment of FIG. 2A-2D. Equal numbers indicate equal or equivalent parts in the two configurations. In this case, however, the channel 17 and the rolling surface 15 have a straight-line development and the winding rollers 1 and 2 have the same diameter. This means that the winding cores can be given a straight path. This is particularly advantageous when the movement of the cores is controlled by mandrels inserted inside them, as described for example in WO-A-02055420.

The use of jets of air can be advantageous also in the case of use of glue. In fact, they ensure correct winding of the core by the web material before rolling of the core causes the longitudinal strip of glue to come into contact with the rolling surface 15, if necessary partially exposed (i.e. not covered by the web material N) as a result of the ventilation caused by the high machine operating speed. This makes the machine more reliable, reduces maintenance and cleaning and avoids the need for a rolling surface 15 with comb-type structure to prevent contact with the glue.

FIGS. 8 and 9A-9E show—limited to the suction and breakage area of the web material N—an embodiment example in which the initial free edge Li generated by tearing of the web material is wound around the new core A2 without the use of glue. The suction member 23 is constructed as in the example of FIG. 5. However, in this case, in the block forming the lower wall 55 two sets of nozzles are provided, indicated by 81 and 83 respectively. These nozzles slant differently with respect to the surface 55A and are arranged on opposite sides of the suction aperture or slot 59. Below the rolling surface 15 a third set of nozzles is provided indicated by 85. While the nozzles 81 and 83 are fixed, the series of nozzles 85 oscillates around a horizontal axis, crosswise with respect to the feed direction of the web material N. The oscillation movement is shown in the sequence of FIG. 9A-9E.

Operation of the machine in this embodiment example is as follows. When the core A2 is upstream of the outlet of the nozzles 81 and the suction aperture 59, the suction is activated and the web material is torn or interrupted at the perforation line P directly downstream of the suction aperture. The nozzles 81 begin to blow downwards, while the suction is interrupted. The jet of air generated by the nozzles 81, which extend over the whole width of the machine, or at least a large part of it, pushes down the initial free edge Li, detaching it from the lower surface 55A of the wall 55. This winds the initial free edge around the new core which, in the meantime, moves forward rolling on the surface 15. Activation of the nozzles 83 pushes the free edge below the core, between the latter and the surface 15.

The jets of air generated by the nozzles 85 also induce the free edge to wedge between the core A2 and the surface 15. When, in its rolling movement, the core A2 goes beyond the vertical plane containing the oscillation axis of the lower oscillating nozzles 85, the latter begin to oscillate in a clockwise direction, consequently rotating the jet of air generated so that it is correctly positioned to push the initial free edge Li to complete formation of the first turn around the core A2.

When the first turn has been completed, the web material N is correctly engaged on the new core and winding of the new log begins.

From the description referring to the use of jets of air generated by the compressed air nozzles 81, 83, 85, it appears clear that in the log which is formed, the first turn, i.e. the innermost turn, is without fold, i.e. it does not turn back in the opposite direction with respect to the winding direction of the remaining part of the web material, as happens in the embodiments described in the preceding examples. This holds true both in the case of a log without central core, i.e. with a hole left by extraction of an extractable recyclable core, and in the case of a log formed around a core which remains inside the log. Furthermore, said advantageous conformation of the log is obtained also in the case of the combined use of glue and air nozzles, obtaining an advantageous result which was previously not possible when the gluing was performed with a longitudinal strip of glue.

Figure 10A:
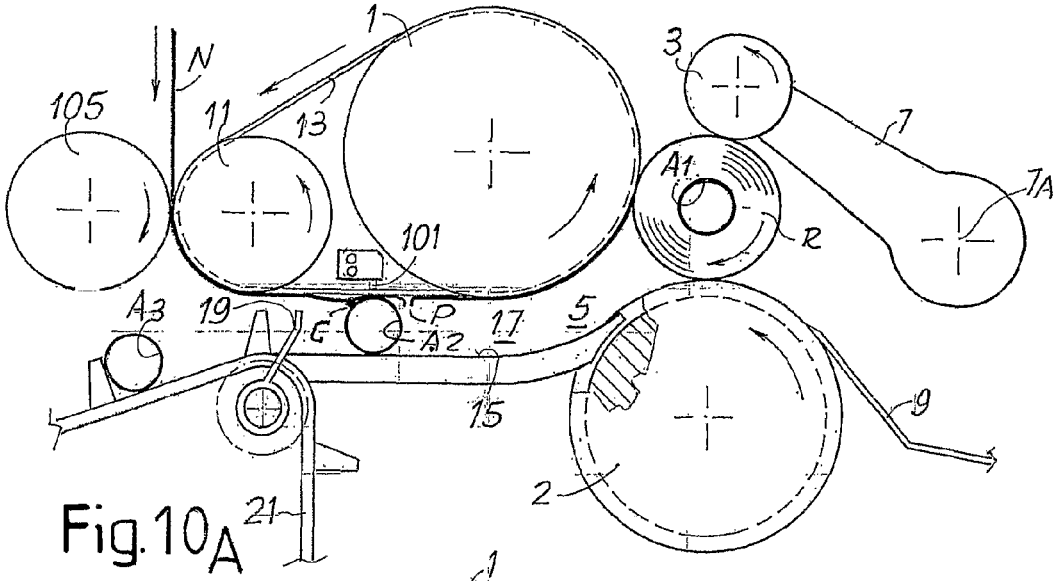
FIG. 10A-10C show an operating sequence of a different embodiment of the machine according to the invention.
Figure 10B:
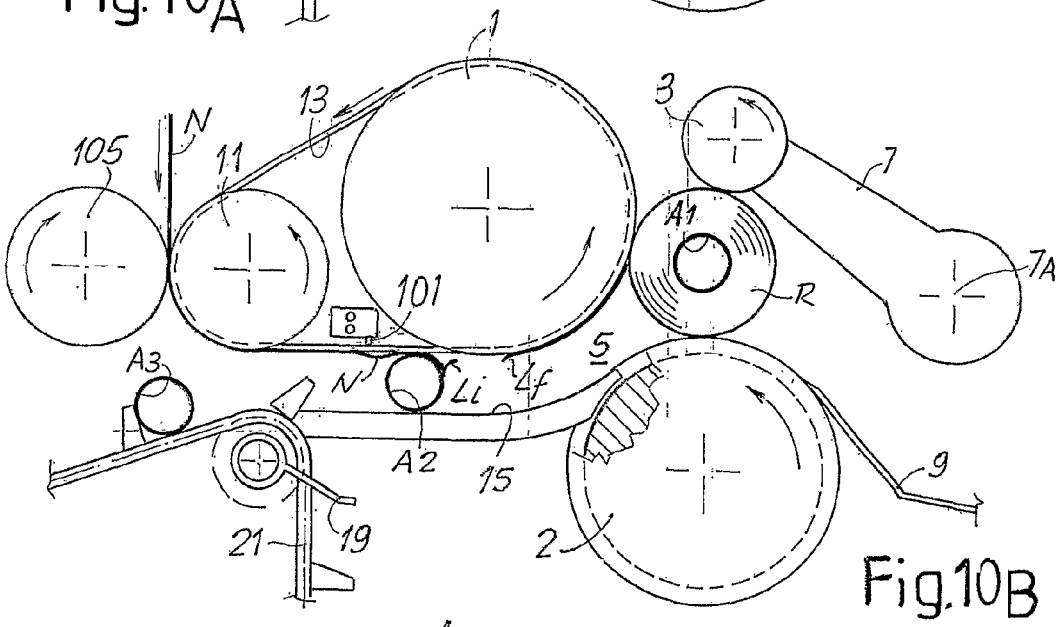
Figure 10C:
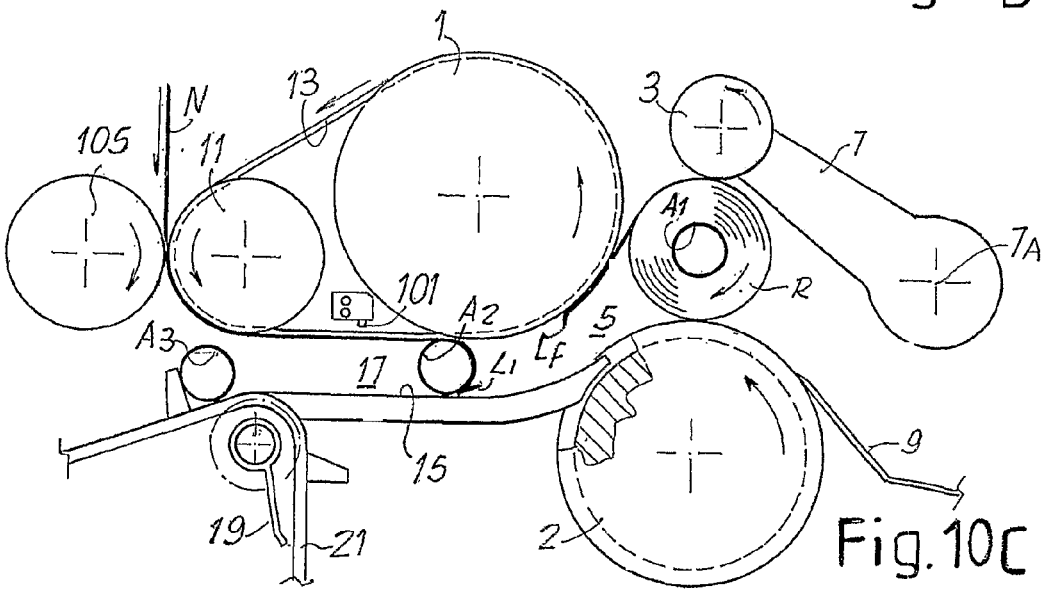

FIG. 10A to 10C show a further embodiment of the machine according to the invention. Equal numbers indicate parts equal or equivalent to those of the preceding embodiment examples. In this embodiment there is no suction system and the interruption is performed by a mechanical interruption member positioned in the area which in the preceding examples is occupied by the suction system. The interruption member comprises a presser or a series of pressers indicated by 101 aligned crosswise to the feed direction of the web material N which is again guided on the belts 13A forming the flexible member 13. The pressers are arranged offset with respect to the belts 13A, so as not to interfere with them and so as to protrude between them towards the surface 15.

The pressers 101 are activated by an actuator (not shown) which controls a movement in a direction orthogonal to the plane on which the web material N lies on the belts 13A.

Operation is as follows. At the end of winding of the log R the core A2 is inserted in the channel formed between the member 13 and the rolling surface 15 by means of the taker-in 19, as already described with reference to the preceding embodiment examples. When the core A2, rolling on the surface 15, passes below the interruption member 101, the latter is lowered so as to press the web material towards and against the core A2 in transit. This causes pinching of the web material and breakage of it along a perforation line P which is located downstream of the point of action of the interruption member 101. In FIG. 10A, where the action of the member 101 is shown, the core A2 is positioned so that the longitudinal line of glue C has not yet come into contact with the web material N. The lowering movement of the member 101 is followed by a sudden lifting, so that it does not obstruct feeding of the initial free edge Li of web material N generated by the tear along the perforation line.

Continuing rolling of the core A2 (FIG. 10B), the strip of glue A comes into contact with the initial free edge Li of the web material N which adheres to the core A2 to begin the winding. In FIG. 10C the core has continued its rolling movement and the strip of glue C is in the lower area. As the core continues to roll, formation of the first turn of web material is completed, the core reaches the nip 5 between the rollers 1 and 2 and enters the winding cradle formed by the rollers 1, 2 and 3.

A roller 105 co-operates with the roller 11 in this embodiment example; said roller 105 rotates at a peripheral speed equal to the feed speed of the material N and therefore at the peripheral speed of the roller 11. This arrangement means that any slackening induced in the web material by the action of the pressers 101 does not spread upstream of the reciprocal point of contact between the rollers 11 and 105.

A further embodiment is illustrated in FIG. 11A-11E, where equal numbers indicate parts equal or equivalent to those of the preceding embodiments. In the embodiment example of FIG. 11A-11E the configuration of the winding-members is substantially the same as in FIG. 2A to 2D. However, as in the case of FIG. 10A-10C, here again the suction member is replaced by a mechanical interruption member. Said mechanical member, indicated by 111, is positioned in the space enclosed within the flexible member 13 and the rollers 1 and 11 and rotates around an axis X parallel to the axis of the rollers. The direction of rotation is, in this example, opposite to the direction of rotation of the rollers 1 and 11, i.e. it rotates in a clockwise direction in the drawing.

The member 111 is provided with a series of pressers 113 fitted at the end of arms of length such that the cylindrical envelope surface of the pressers 113 protrudes slightly from the surface defined by the belts 13A forming the flexible member 13.

Figure 11A:
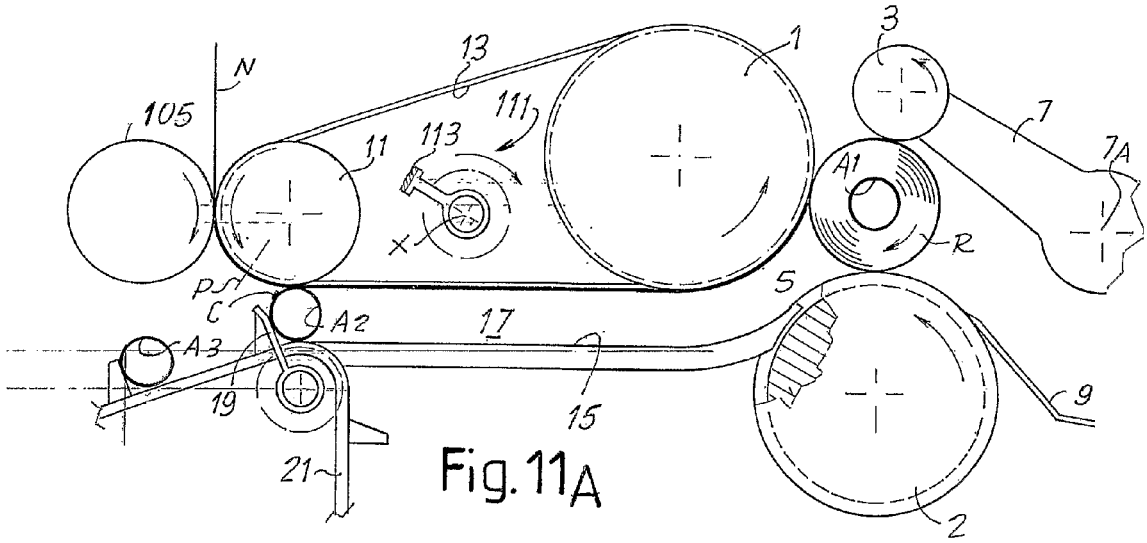
FIG. 11A-11E show an operating sequence of a further embodiment of the machine according to the invention.

In FIG. 11A the log R formed around the core A1 is in the winding cradle formed by the rollers 1, 2 and 3 and has been almost completed. The new core A2 is pushed by the taker-in 19 into the channel 17 formed between the belts 13A of the flexible member 13 and the rolling surface 15. P indicates the instantaneous position of the perforation line along which the web material will break. Said position is upstream of the position of the new core A2. The interruption member 111 is rotating around its own rotation axis X and the pressers 113 are facing upwards, i.e. on the opposite side with respect to the channel 17.

Figure 11B:
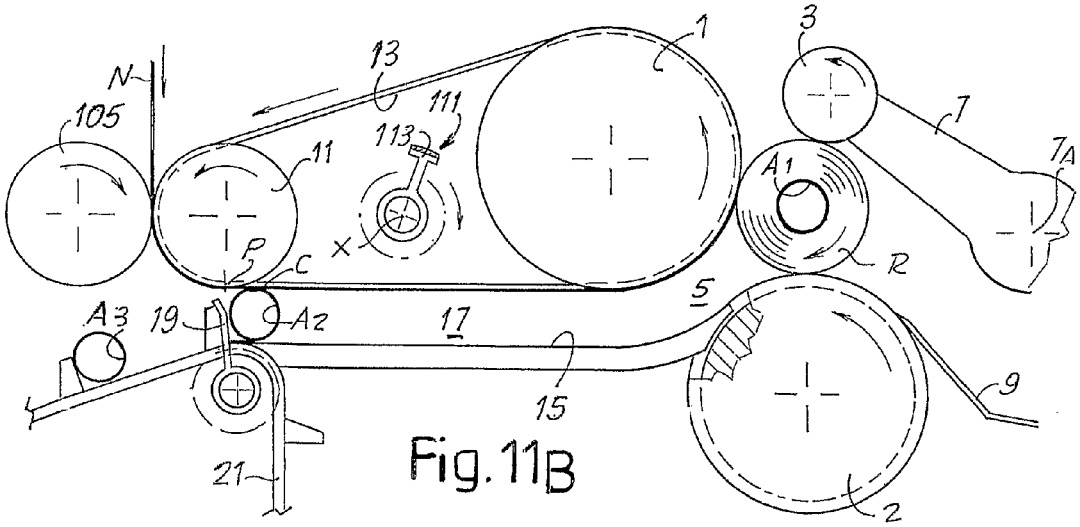

In FIG. 11B the core A2 is beginning to roll in the channel 17 and the longitudinal strip of glue C is in contact with the web material N guided by the flexible member 13, thus applying a strip of glue C1 which will serve to close the final free edge forming after the tear. The rotating interruption member 111 continues its rotation. The perforation line P along which the web material will be interrupted is still upstream of the core A2.

Figure 11C:
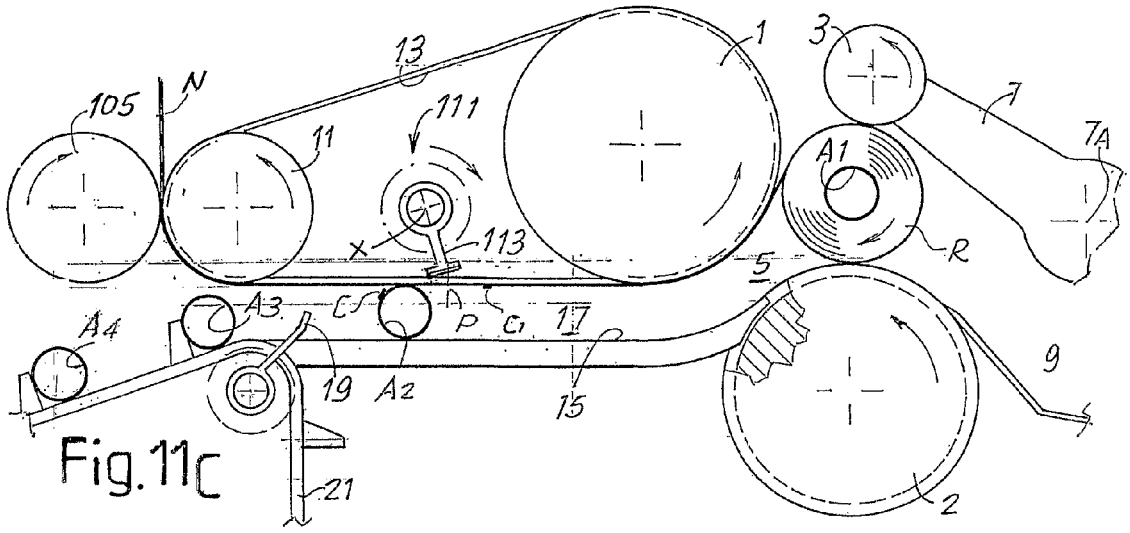

In FIG. 11C the core has advanced farther, rolling on the surface 15, the perforation line P is downstream of the core A2 and the strip of glue C1 has been applied downstream of said line. The pressers 113 of the rotating interruption member 111 are now facing downwards, about to penetrate between the belts 13A.

Figure 11D:
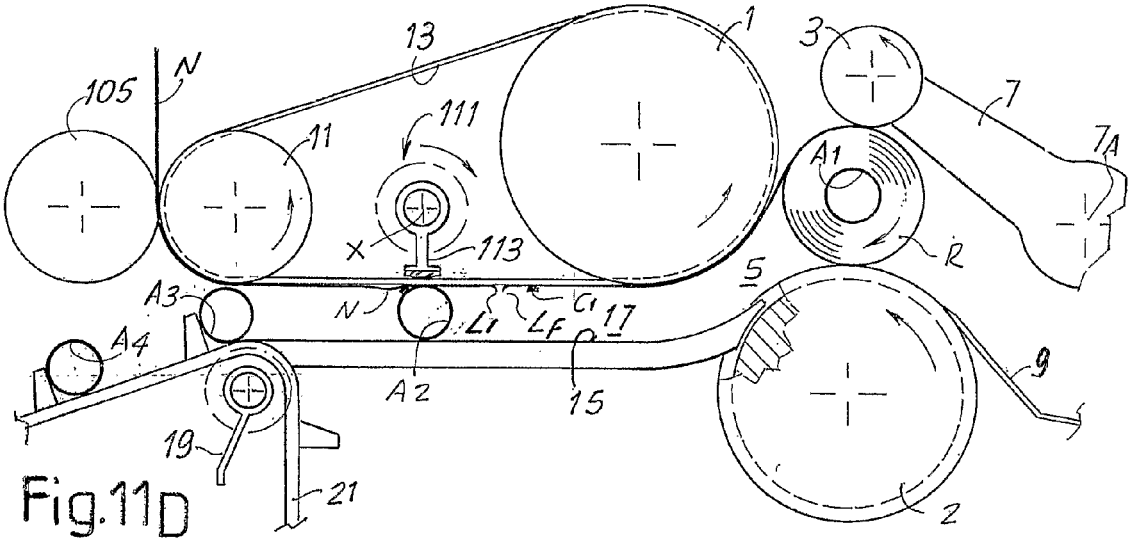
Figure 11E:
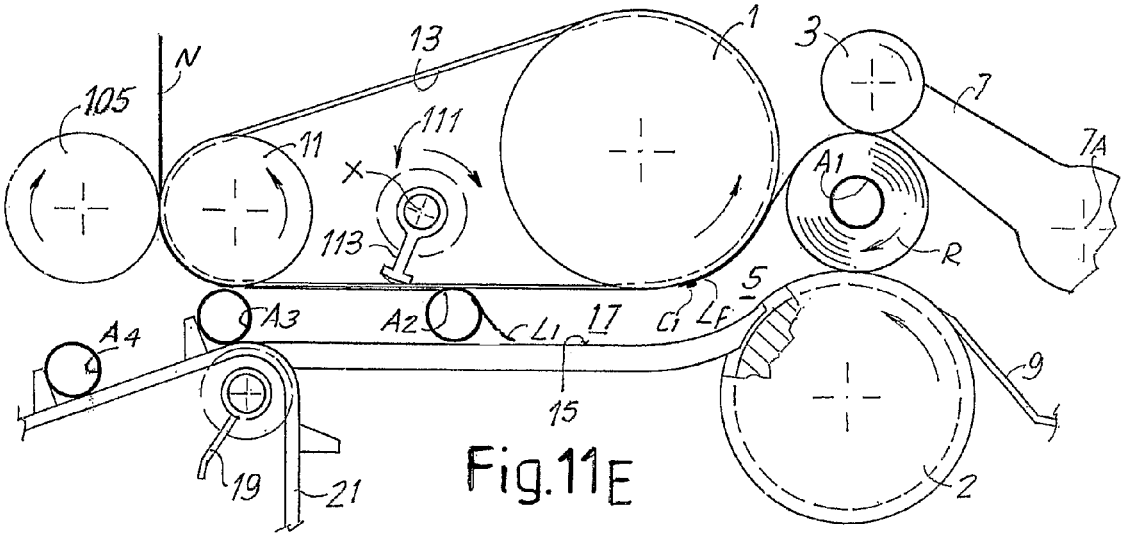

In FIG. 11D the pressers 113 are in a position orthogonal to the surface defined by the lower branch of the flexible member 13, at the moment when the core A2 passes below them. In this way, due to the fact that the pressers 113 (coated in elastic material with high friction coefficient) protrude slightly beyond the flexible member 13, the web material N is pinched between said pressers and the core A2. The speed of the member 111 is different from the speed of the web material (opposite in the example) and this causes tearing due to over-tensioning of the web material along the perforation line P. FIG. 11E shows the moment after, when the member 111 is no longer in contact with the web material N, the final free edge of which Lf finishes winding on the log R and is provided with the strip of glue C1, while the initial free edge Li begins to wind on the new core, the strip of glue C coming into contact with the material N for the second time. Here again, as in the case of FIG. 2C, an auxiliary glue applicator can be provided.

The member 111 could also rotate in the opposite direction with respect to the direction indicated in FIG. 11A-11E, provided that the pressers 113 have a different speed with respect to the speed of the web material N, to exert a braking effect on it and therefore to tension it and break it.

In a different embodiment, not illustrated, the mechanical interruption member, whether configured as in FIG. 10A-10D or as in FIG. 11A-11E, can act in advance with respect to passage of the core A2. In this case it will not have the effect of countering the core A2. Tearing of the web material can nevertheless be obtained, for example by giving the surface of the interruption member which comes into contact with the web material a particularly high friction coefficient, with a slightly abrasive or adherent coating, for example a coat of abrasive material. Alternatively, the mechanical member can be provided with tips or pins that penetrate the web material, retaining it or pulling it in the opposite direction with respect to the feed direction of the web material N. This solution can be adopted also in the example of FIG. 10A-10C, where the movable member can penetrate the web material with tips or pins to block it or brake it more effectively. In any case the mechanical member exerts a retarding, braking, retaining or obstructing action to the forward movement of the web material N, and this action is sufficient to cause tearing thereof. Vice versa provision can be made for the mechanical member, when it rotates as in the example in FIG. 11A-11E, to exert a local acceleration action on the web material. For example the mechanical member can rotate so that, when it acts on the web material N, it moves in the same direction as the latter but at a higher speed. By providing a surface with a sufficiently high friction coefficient and/or a series of tips or pins which penetrate the web material, the web material can be tensioned between the pinching point by the new core A2 and the point of contact with the mechanical interruption member. The interruption is performed by tearing of the perforation line which is located, by appropriate timing of the machine, in the portion of the web material subject to traction.

The winding core can be a core designed to remain in the end product, or can be extracted after winding of the log and recycled if necessary. The web material interruption system acts in both cases in an equivalent way.

FIGS. 12A-12E, 13 and 14 show a further embodiment of the invention. The same reference numbers as in the previous figures are used to designate identical or equivalent parts. Parts which are common to the previous embodiments are not described again and reference can be made to the previous description.

Also in this embodiment above the lower branch of the insertion member 13 is an interruption member 201 of the web material N in the switchover phase, i.e. when the log R is almost complete and the web material N has to be interrupted to generate a final free edge to be wound on the finished log R and a free initial edge to be wound on a new core A inserted in the channel 17 to start a new log at the beginning of winding.

Figure 13:
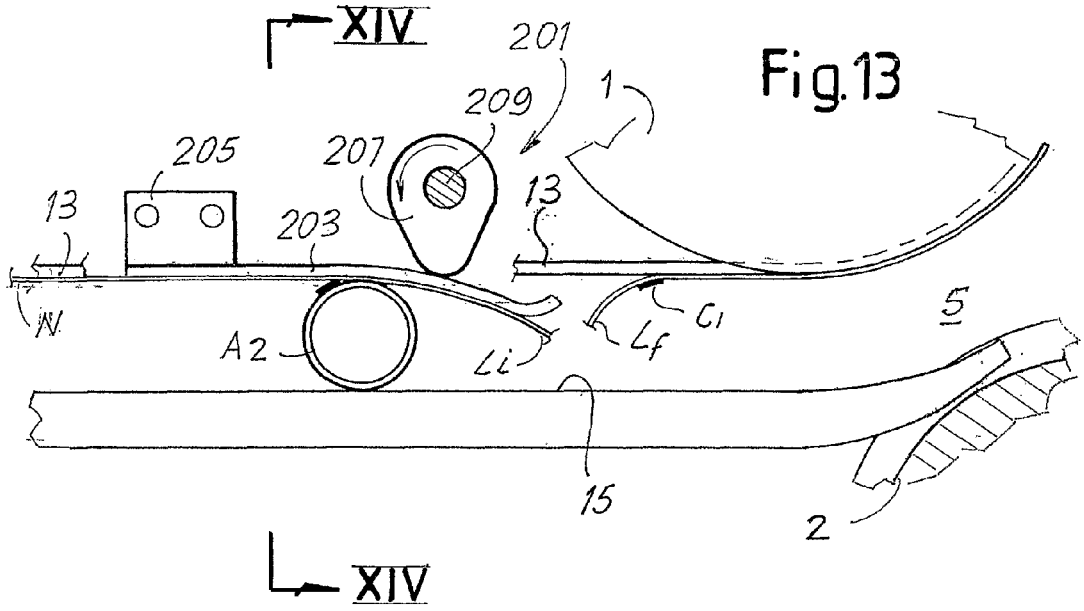
FIG. 13 shows an enlargement of the interruption area of the web material in the embodiment of FIGS. 12A-12E.
Figure 14:
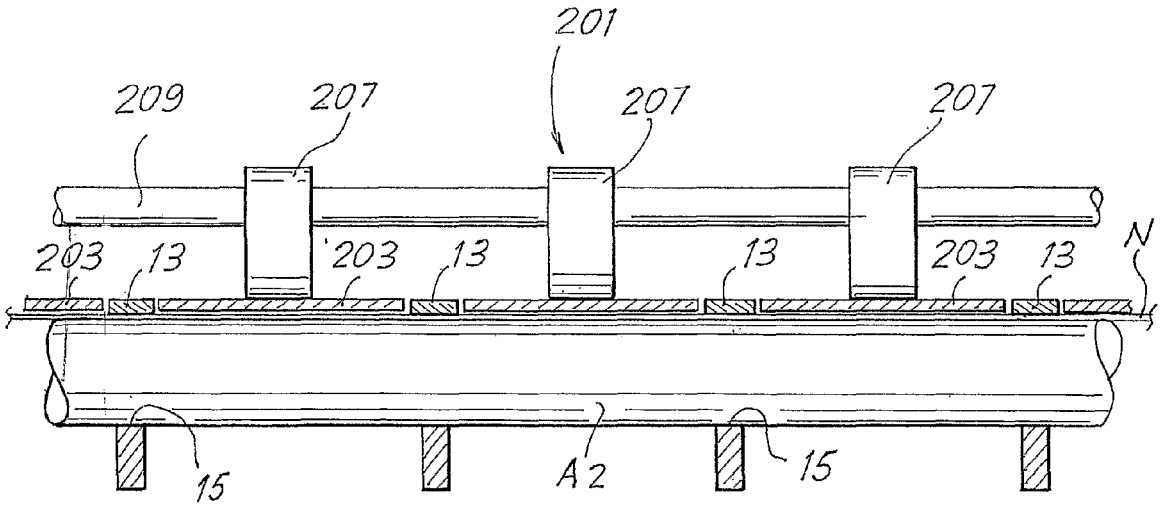
FIG. 14 shows a section according to XIV-XIV of FIG. 13.

The interruption member 201 comprises a series of elastic laminas 203 connected at one end to a cross member 205 and overhanging said cross member in the feed direction of the web material N. The cross member 205 is above the belts forming the flexible member 13, while the elastic laminas 203 are offset between the belts and substantially at the same level as the latter, as can be seen in FIG. 13. Above each elastic lamina 203 is an eccentric or a cam 207. All the cams or eccentrics 207 are aligned and fitted on a common shaft 209, rotation of which is controlled by an actuator, for example a brushless motor or other electronic control electric motor, not shown. Alternatively two or more shafts activating the cams or eccentrics 207 can be provided.

In the example illustrated the cams are all arranged at the same angle and therefore act at the same moment on the elastic laminas 203 below. It is, however, possible to arrange the cams or eccentrics 207 at a variable angle, so that they act gradually on the laminas, i.e. deforming the various laminas differently over time. This can be used to achieve gradual breakage of the web material, for example starting from an edge and proceeding towards the opposite edge, or beginning from the center and proceeding towards the two edges. This type of breakage method can be useful in particular for materials that are particularly resistant.

As can be seen from the drawing and as will be clarified in further detail below, rotation of the cams or eccentrics 207 causes—at a certain moment—bending downwards of the laminas 203, which in this way protrude inside the channel 17, beyond the lower surface of the belts 13, diverting and elongating the path of the web material N, which consequently tears.

Figure 12A:
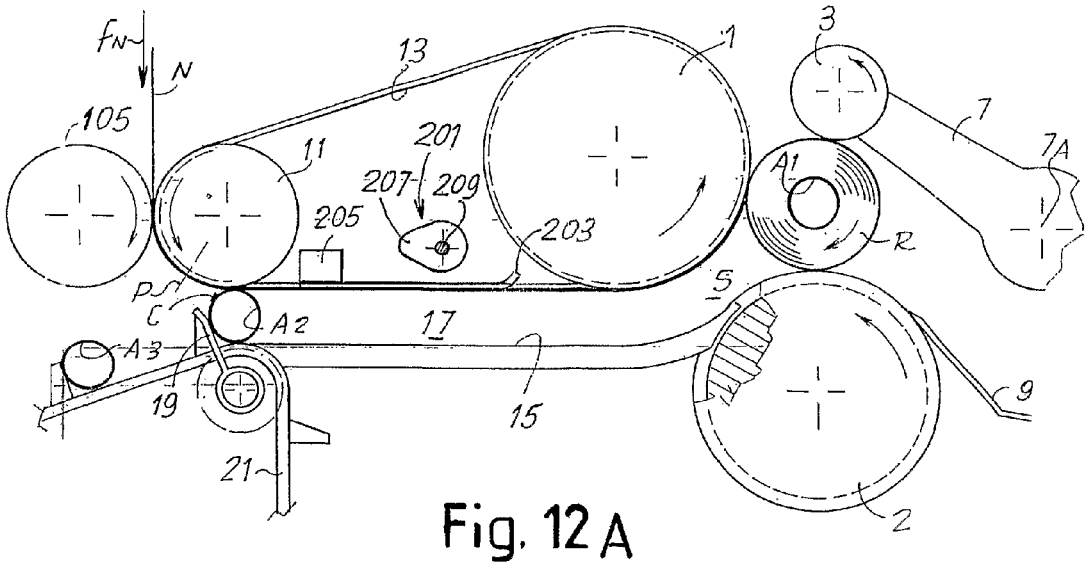
FIG. 12A-12E show in a schematic side view the rewinding machine in a succession of operating phases during a winding cycle in a further embodiment.

Operation of the machine described so far is as follows. FIG. 12A shows the moment before breakage or interruption of the web material. The log R wound around the winding core indicated by A1 is ready to be expelled from the winding cradle, while a new core A2 is inserted by the taker-in 19 in the channel 17.

The core A2, coming into contact with the belts forming the member 13 and with the roller 11, is rapidly angularly accelerated until its point of contact with the web material N is brought to the same feed speed as the web material itself.

On the surface of the core a longitudinal strip of glue C is applied which, at this moment, is upstream of the point of contact between the core A2 and the web material N.

The rolling surface 15 has a comb-like structure (or at least a series of notches) to allow the taker-in 19 to complete rotation around its rotation axis and prepare for insertion of the next core.

P indicates the position of a crosswise perforation line, generated on the web material N by the perforator (not shown), along which the web material will tear. At the moment shown in FIG. 12A it is upstream of the core A2 and moves forward with the web material N at a speed substantially double the speed at which the axis of the core A2 will move forward along the channel 17 due to the effect of its rolling on the fixed surface 15.

The cams 207 are in a position such that they do not push the elastic laminas 203 below the lower surface of the belts 13.

Figure 12B:
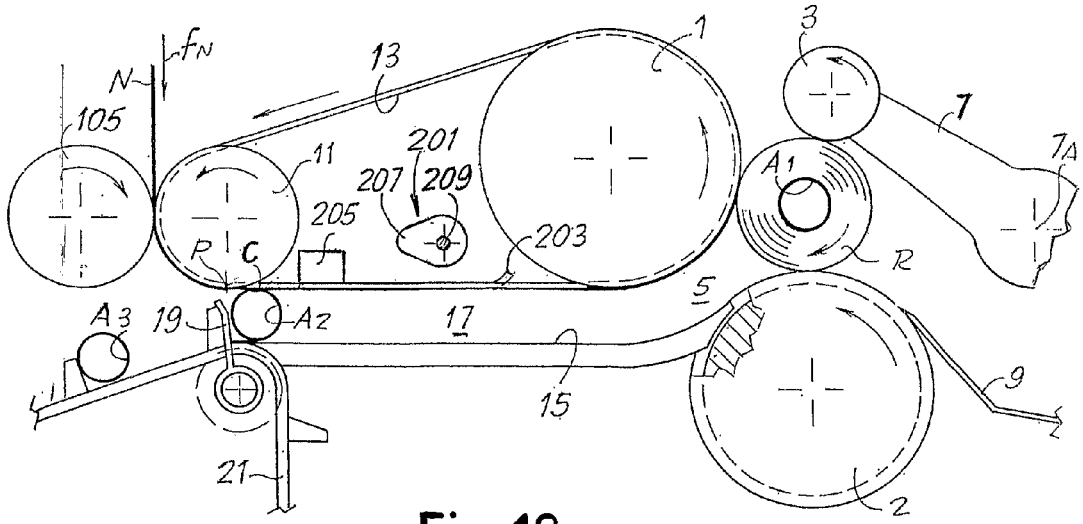

In FIG. 12B the core is beginning to roll along the channel 17, while the web material N continues to wind on the log R and the elastic laminas 203 do not yet protrude below the belts 13.

Figure 12C:
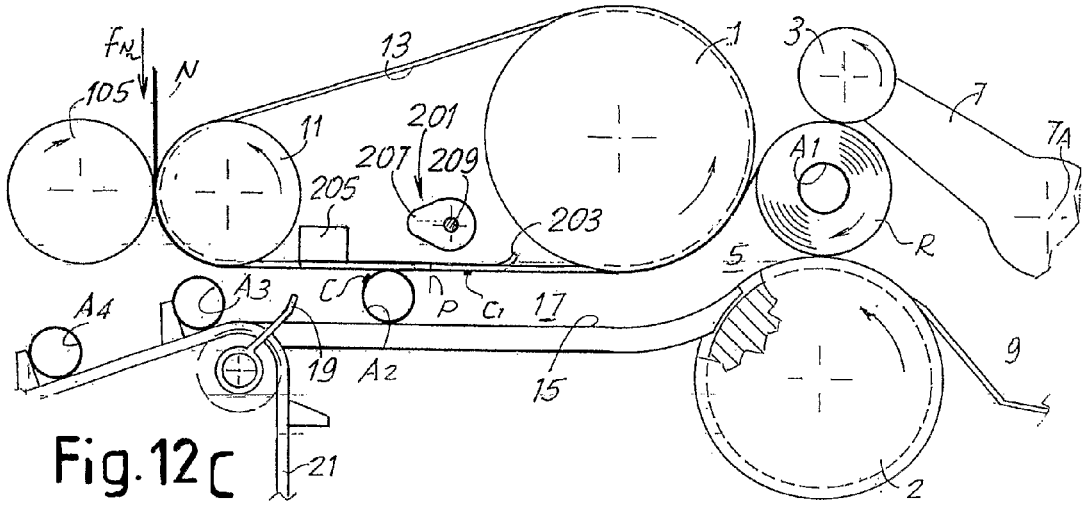

In FIG. 12C the core has moved forward to approximately one third of the length of the channel 17 and the perforation line P has passed in front of the core (since its feed speed is double the feed speed of the axis of the core A2). The core has performed one complete revolution from the moment of insertion in the channel 17, the strip of glue C has come into contact with the web material N, and a part of the glue C has been transferred to the material N, here forming a strip C1, for the purposes described herein.

Figure 12D:
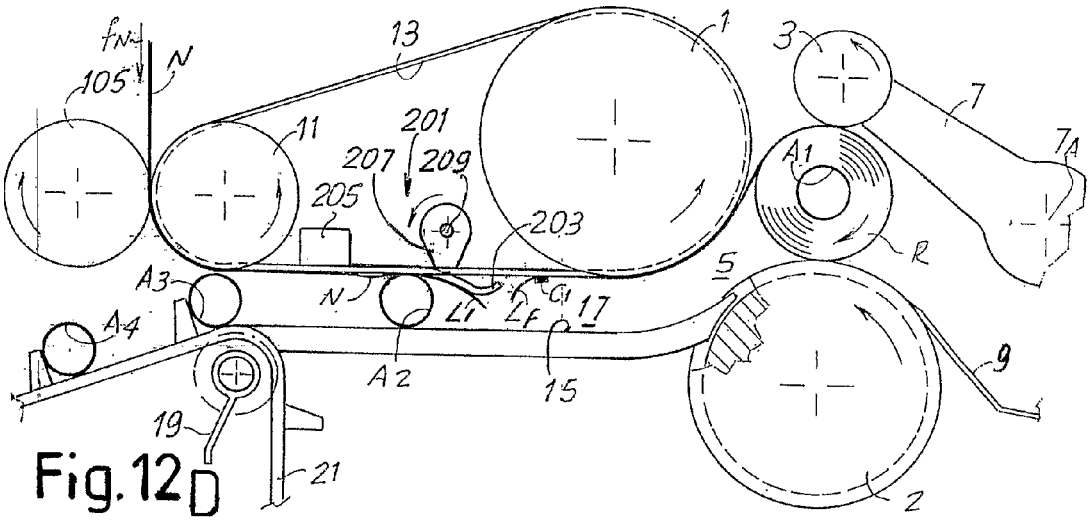

In FIG. 12D the perforation line P is approximately below the free ends of the elastic laminas 203, which have been pushed downwards inside the channel 17, protruding below the lower surface of the belts 13, by means of the cams or eccentrics 207.

Consequently the path of the web material N between the log R and the new core A2 is elongated, since the material N follows the elastic laminas 203. On the other hand, the web material is retained on the surface of the winding roller 1, which is usually coated in material with a high friction coefficient. In the example illustrated, the log being completed has already been partially moved away from the winding roller around which the web material runs. It is possible, however, also for the purpose of improving the grip between web material and winding roller, for the log R to be still in contact with the winding roller 1 in this phase. In this case, the material N is pinched by the log R against the roller.

The material N is also pinched between the belts 13 forming the flexible member and the new core A2, so that it cannot slide freely with respect to the elastic laminas 203. The latter, causing elongation of the path of the web material beyond the elongation permitted by the elastic deformability of the material, cause it to tear or break.

The movement of the core A2 and the elastic laminas 203 is synchronized with the position of the perforation P, along which the web material tears. The tear generates a free final edge Lf of the material which will finish winding on the log R and a free initial edge Li which will begin to wind on the new core A2.

The strip of glue C1 passed by the core A2 to the web material N is (after tearing) adjacent to the free final edge Lf. This part of glue serves to close the free final edge Lf of the log. The remaining part of the glue still on the core A2 serves to ensure adhesion of the initial portion of the web material, adjacent to the edge Li, to the new core A2.

It is also possible for the glue C not to be transferred to the web material to be wound on the log R and for the free final edge Lf to be glued by means of a gluing machine downstream of the rewinding machine.

Instead of glue, other systems can be used to begin winding of the web material around the new core, for example air nozzles, electrostatic charges or similar.

Once breakage of the web material has been completed, the cams 207 continue to rotate, moving away and causing a corresponding return of the elastic laminas 203 between the belts 13. The core A2 can therefore pass freely, moving towards the nip 5. It is also possible to use the laminas to increase the pressure on the core A2 in order to improve gluing of the free edge.

Since the rollers 1 and 11 continue to rotate, after breakage of the web material the feed member 13 continues to roll and move the core A2 forward along the channel 17.

Figure 12E:
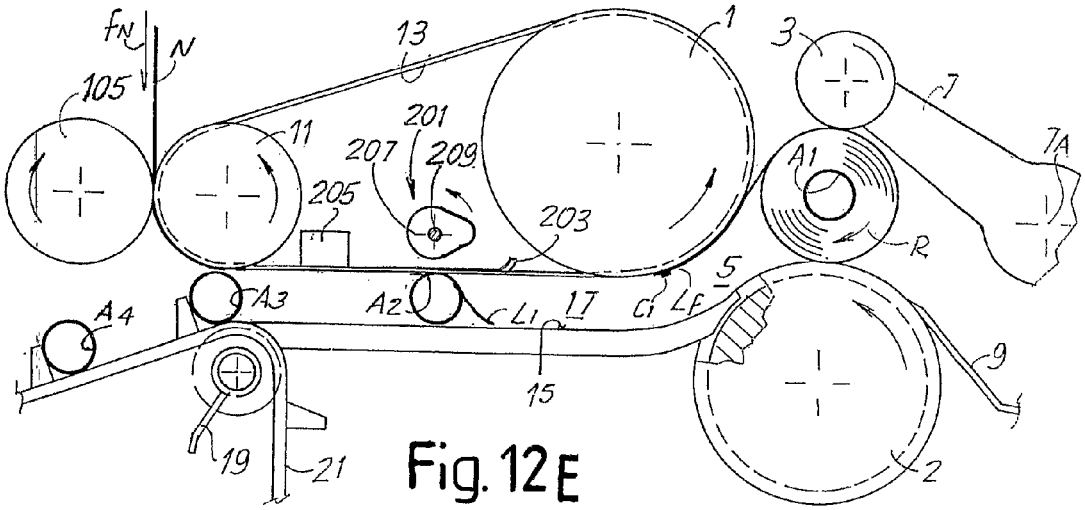

FIG. 12E shows the discharge phase of the log R, which can be expelled from the winding cradle accelerating the upper winding roller 3 and/or slowing down the lower winding roller 2. The initial free edge Li begins to wind around the core A2 and the elastic laminas 203 returned to their rest position, flush with the lower surface of the belts 13 (or above them). The core A2 will move forward until it crosses the nip 5 and reaches the winding cradle between the rollers 1, 2, 3, left free by the completed log R and here will terminate winding of the new log on the core A2. Once this winding has been completed, the switchover cycle described above is repeated.

The relative position between the flexible laminas 203 and the new winding core A2 during insertion in the channel 17 can be selected and/or adjusted also according to the specific machine operating modes. The dimension and in particular the length of the laminas can also be chosen according to the required mode of performance of the above-mentioned operations. In fact, deformation of the flexible elastic laminas 203 can be circumscribed to the area downstream of the new core A2, or a more or less marked deformation can be provoked also in the area of the core or upstream of it. Bending of the laminas can thus have a greater or lesser braking effect on the core which contributes to braking the web material and tearing it. If this braking effect is not necessary or useful for tearing the material, elongation of the path provided by bending of the laminas downstream of the core A2 being in any case sufficient, bending of the laminas can be circumscribed completely downstream of the core A2, with the advantage of avoiding slackening of the web material N upstream of the core.

The drawing only shows practical embodiments of the invention, which can vary in the forms and arrangements without departing from the scope of the concept underlying the invention. The presence of reference numbers in the appended claims has the sole aim of facilitating reading thereof in the light of the description and appended drawings, but does not limit the scope of its protection in any way.

The invention claimed is:

1. A rewinding machine for winding a web material into logs comprising: a feed path for feeding web material towards a winding system; an interruption member to interrupt the web material at an end of winding of a log; a core feeder to sequentially insert winding cores in a channel defined by a rolling surface and a movable core feed member constructed and arranged so that when a core is inserted in said channel the web material is between said core and said feed member and in contact with said feed member, said feed path extending along said channel; wherein said interruption member is associated with said feed member, wherein said interruption member is arranged on a side of said feed path which includes said feed member and said side of said feed path being opposite said rolling surface and said interruption member being positioned at least partly on an opposite side of said feed member with respect to said channel to act on the web material through said feed member, and wherein said interruption member is timed to operate when the web material is to be severed.

2. The rewinding machine as claimed in claim 1, wherein said feed member comprises a flexible member running between at least two rollers and wherein said interruption member is positioned between said two rollers, within a closed path defined by said flexible member.

3. The rewinding machine as claimed in claim 2, wherein said flexible member comprises a plurality of parallel belts between which said interruption member operates.

4. The rewinding machine as claimed in claim 3, wherein one of said at least two rollers is a first winding roller of a surface winding cradle forming said winding system.

5. The rewinding machine as claimed in claim 3, wherein said interruption member is a suction member which provides timed suction which applies a force on said web material in a manner to obstruct feed of the web material to tension and break the web material.

6. The rewinding machine as claimed in claim 2, wherein one of said at least two rollers is a first winding roller of a surface winding cradle forming said winding system.

7. The rewinding machine as claimed in claim 6, further comprising a second winding roller, which defines with said first winding roller a nip for passage of the web material.

8. The rewinding machine as claimed in claim 7, wherein said nip is positioned substantially at an end of said channel of the winding cores.

9. The rewinding machine as claimed in claim 2, wherein said interruption member is a suction member which provides timed suction which applies a force on said web material in a manner to obstruct feed of the web material to tension and break the web material.

10. The rewinding machine as claimed in claim 9, wherein said suction member comprises a counter surface along which said flexible member runs.

11. The rewinding machine as claimed in claim 10, wherein said interruption member is a mechanical member which acts on the web material extending through said feed member.

12. The rewinding machine as claimed in claim 11, wherein said mechanical member is arranged to act on the web material to apply said tension on the web material and cause the web material to tear.

13. The rewinding machine as claimed in claim 11, wherein said mechanical member is arranged to act on the web material to obstruct feed of the web material.

14. The rewinding machine as claimed claim 11, wherein said mechanical member includes tips or pins which penetrate the web material.

15. The rewinding machine as claimed in claim 11, wherein said mechanical interruption member is synchronized with said core feeder to act on the web material in conjunction with a winding core which is being fed along the channel.

16. The rewinding machine as claimed in claim 11, wherein said mechanical interruption member is arranged to move substantially orthogonally to a feed direction of the web material.

17. The rewinding machine as claimed in claim 16, wherein said mechanical interruption member is arranged to pinch the web material against a winding core.

18. The rewinding machine as claimed in claim 11, wherein said mechanical interruption member is a rotating member.

19. The rewinding machine as claimed in claim 18, wherein said mechanical interruption member is arranged to rotate around an axis substantially parallel to axes of rotation of said at least two rollers around which said flexible member runs, and at a moment when the web material is interrupted, protrudes towards said channel.

20. The rewinding machine as claimed in claim 18, wherein said mechanical interruption member is arranged to, at least during an interruption of said web material, to rotate at a peripheral speed different from a feed speed of the web material.

21. The rewinding machine as claimed in claim 1, wherein said interruption member is a suction member which provides timed suction which applies a force on said web material in a manner to obstruct feed of the web material to tension and break the web material.

22. The rewinding machine as claimed in claim 1, further comprising a glue applicator for applying glue on said cores.

23. Rewinding machine as claimed in claim 1, further comprising blower nozzles arranged to facilitate winding of a free edge of the web material around the winding core.

24. The rewinding machine as claimed in claim 23, further comprising at least a first set of blower nozzles and a second set of blower nozzles arranged upstream and downstream of the web material suction application area.

25. The rewinding machine as claimed in claim 24, wherein said first set of blower nozzles and said second set of blower nozzles are arranged on a common side of the channel.

26. The rewinding machine as claimed in claim 23, further comprising a third set of blower nozzles.

27. The rewinding machine as claimed in claim 26, wherein at least one set of said blower nozzles is constructed and arranged to oscillate or rotate around a crosswise axis with respect to a feed direction of the web material.

28. The rewinding machine as claimed in claim 27, wherein said third set of blower nozzles oscillates.

29. The rewinding machine as claimed in claim 28, wherein said third set of blower nozzles is arranged on an opposite side of the channel with respect to said first set of blower nozzles and said second set of blower nozzles.

30. The rewinding machine as claimed in claim 23, wherein at least a portion of said blower nozzles is constructed and arranged to oscillate or rotate around a crosswise axis with respect to a feed direction of the web material.

31. The rewinding machine as claimed in claim 23, wherein said rewinding machine has no means for applying glue to the winding cores and initiation of winding of each log is by said blower nozzles.

32. The rewinding machine as claimed in claim 1, wherein a path of the winding cores is constructed and arranged so that each core rolls along said path a distance sufficient to transfer a portion of glue previously applied on said core to a portion of the web material which will form a final free edge of the log.

33. The rewinding machine as claimed in claim 1, wherein said interruption member comprises at least one diverter element which acts on the web material across said feed member and protrudes into said channel.

34. The rewinding machine as claimed in claim 33, wherein said diverter element comprises at least one elastic lamina.

35. The rewinding machine as claimed in claim 34, wherein said at least one elastic lamina is connected to a cross member positioned, with respect to said feed member, on an opposite side of said channel.

36. The rewinding machine as claimed in claim 35, wherein said cross member runs crosswise to a feed direction of the core in said channel, said at least one elastic lamina extending from said cross member in the feed direction.

37. The rewinding machine as claimed in claim 34, wherein activation of said elastic laminas is staggered over time to cause gradual breakage of said web material.

38. The rewinding machine as claimed in claim 33, wherein said interruption member comprises an actuator which acts on said at least one diverter element to cause movement or deformation thereof across said feed member towards an inside of said channel.

39. The rewinding machine as claimed in claim 38, wherein said actuator comprises at least one cam positioned, with respect to said feed member on an opposite side of said channel.

40. The rewinding machine as claimed in claim 33, wherein said feed member comprises at least two flexible members, and wherein said diverter element is positioned between said at least two adjacent flexible members.

41. The rewinding machine as claimed in claim 40, wherein said interruption member comprises a plurality of diverter elements positioned between adjacent flexible members.

42. The rewinding machine as claimed in claim 33, wherein said diverter element is constructed and arranged to brake the core and slacken the web material upstream of the core.

43. The rewinding machine as claimed in claim 33, wherein said diverter element is constructed and arranged to prevent slackening of the web material upstream of said core.

44. A method for producing logs of wound web material comprising:

feeding a web material to a winding system along a feed path extending along a channel defined between a rolling surface and a movable core feed member;

winding a first log of web material around a first winding core;

inserting a new winding core in said channel and feeding said core along said channel with the web material between said core and said feed member; and interrupting the web material at an end of winding of said first log forming a final free edge of said first log and an initial free edge for winding of a second log, wherein said web material is interrupted by an interruption member which is activated at predetermined times to act on the web material along the channel on a side of the feed path which includes said interruption member and said feed member and opposite said rolling surface which is across from said feed member.

45. The method as claimed in claim 44, wherein said winding system is a surface winding system comprising a winding cradle.

46. The method as claimed in claim 45, wherein said interruption member applies timed suction on the web material thereby applying a force on the web material which causes tensioning and breaking of the web material.

47. The method as claimed in claim 46, wherein the web material is fed along a counter surface on which said suction is applied and along which said core feed member runs.

48. The method as claimed in claim 44, wherein said interruption member applies timed suction on the web material thereby applying a force on the web material which causes tensioning and breaking of the web material.

49. The method as claimed in claim 48, wherein the web material is fed along a counter surface on which said suction is applied and along which said core feed member runs.

50. The method as claimed in claim 49, wherein said counter surface is fixed.

51. The method as claimed in claim 49, wherein said timed suction is applied downstream of a position of said core along the feed path, causing interruption of the web material downstream of said core.

52. The method as claimed in claim 44, wherein said interruption member is a mechanical member which acts mechanically on the web material.

53. The method as claimed in claim 52, wherein the web material is pinched between said mechanical interruption member and said second core.

54. The method as claimed in claim 52, wherein said mechanical interruption member contacts the web material, the mechanical interruption member moving at a different speed from a feed speed of the web material.

55. The method as claimed in claim 44, wherein glue is applied on said winding cores.

56. The method as claimed in claim 55, wherein said glue is applied along at least one longitudinal line.

57. The method as claimed in claim 55, wherein at least a part of said glue is transferred to a portion of the web material belonging to a final free edge of the web material to close the final free edge of said log.

58. The method as claimed in claim 44, wherein winding of an initial free edge of the web material around said winding core is started or facilitated by one or more jets of air.

59. The method according to claim 44, wherein said interruption member includes at least one diverter element which is made to protrude into said channel when the web material is to be interrupted.

60. The method as claimed in claim 59, wherein said diverter element comprises an elastic lamina.

61. The method as claimed in claim 59, wherein said web material is interrupted causing a plurality of said diverter elements to protrude into said channel.

62. The method as claimed in claim 61, wherein said diverter elements are made to protrude into said channel staggered over time to cause gradual breakage of the web material.

* * * * *